US006533355B2

(12) United States Patent
Broekhuis et al.

(10) Patent No.: US 6,533,355 B2
(45) Date of Patent: Mar. 18, 2003

(54) HEIGHT-ADJUSTMENT MECHANISM FOR A CHAIR

(75) Inventors: Michael D. Broekhuis, West Olive, MI (US); Patrick C. Nelson, Holland, MI (US); Richard N. Roslund, Jr., Jenison, MI (US); Stephen J. Simpson, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/819,540

(22) Filed: Mar. 28, 2001

(65) Prior Publication Data

US 2002/0140266 A1 Oct. 3, 2002

(51) Int. Cl.[7] ..... B60N 2/02
(52) U.S. Cl. ..... 297/353; 74/422
(58) Field of Search ..... 297/353, 411.36, 297/463.1; 248/161, 157, 407, 408; 74/422

(56) References Cited

U.S. PATENT DOCUMENTS

| | | | | |
|---|---|---|---|---|
| 934,121 A | | 9/1909 | Witte | |
| 1,182,855 A | | 5/1916 | Poler | |
| 2,393,242 A | | 1/1946 | Flogaus | |
| 2,405,013 A | | 7/1946 | Campbell | |
| 3,194,187 A | | 7/1965 | Linder et al. | |
| 4,221,430 A | | 9/1980 | Frobose | |
| 4,451,084 A | | 5/1984 | Seeley | |
| 4,466,665 A | | 8/1984 | Aronowitz et al. | |
| 4,616,877 A | | 10/1986 | Slaats et al. | |
| 4,627,591 A | | 12/1986 | Heckmann | |
| 4,639,039 A | * | 1/1987 | Donovan | 297/353 |
| 4,749,230 A | | 6/1988 | Tornero | |
| 5,037,158 A | | 8/1991 | Crawford | |
| 5,388,892 A | | 2/1995 | Tornero | |
| 5,597,204 A | | 1/1997 | Karaus, Jr. | |
| 5,620,233 A | | 4/1997 | Corwin | |
| 5,649,741 A | | 7/1997 | Beggs | |
| 5,685,609 A | | 11/1997 | Miotto | |
| 5,695,249 A | * | 12/1997 | Lotfi | 297/353 |
| 5,795,026 A | * | 8/1998 | Dral et al. | 297/411.36 |
| 6,276,757 B1 | * | 8/2001 | Brown | 297/353 |
| 6,283,422 B1 | * | 9/2001 | Stoelinga | 248/188.2 |

* cited by examiner

*Primary Examiner*—Peter M. Cuomo
*Assistant Examiner*—Stephen Vu
(74) *Attorney, Agent, or Firm*—Flynn, Thiel, Boutell & Tanis, P.C.

(57) ABSTRACT

A height adjustment mechanism in a chair operates automatically by raising and lowering a chair component such as a chair back. The height adjustment mechanism is provided on a chair back or other chair support and includes a gear which engages a rack member that is vertically movable relative thereto in response to movement of the chair back. A locking member is provided which engages the gear to prevent downward movement of the chair back while still permitting upward movement of the chair back. A disengagement member also is provided to separate the gear and the locking member and maintain the gear in a disengaged position that permits lowering of the chair back.

28 Claims, 21 Drawing Sheets

HEIGHT-ADJUSTMENT MECHANISM FOR A CHAIR

FIELD OF THE INVENTION

The invention relates to a height adjustment mechanism for a chair and more particularly, to a height adjustment mechanism such as for a chair back.

BACKGROUND OF THE INVENTION

Conventional office chairs typically have a seat assembly as well as a back assembly which extends upwardly from a rear edge of the seat for respectively supporting the seat and back of the chair occupant. The seat assembly typically includes a rigid upright and the back assembly is supported on the upright. Also, such chairs often include a pair of chair arms which extend upwardly from the opposite side edges of the seat assembly for supporting the occupant's arms.

In a continuing effort to provide more comfortable office chairs, many of the chair components are adjustable in various directions so that the components of the chair more closely conform to and comfortably support the seat, arms and back of the occupant. In this regard, it is well known to provide a height adjusting mechanism in the back assembly of the chair which permits the height of the chair to be adjusted relative to the seat assembly. Height adjusting mechanisms also are known to be provided in chair arms to permit vertical adjustment thereof.

With respect to such height adjusting mechanisms and primarily those height-adjusting mechanisms used in the back assembly, many of these mechanisms include ratchet-like mechanisms having a vertically elongate row of teeth, which define a rack, and a pawl which engages the rack. These ratchet mechanisms permit the back assembly to be manually lifted upwardly along the upright wherein the mechanism maintains the back assembly at a selected elevation when the occupant releases the back assembly.

Many of these mechanisms include actuator parts such as levers, pins and the like which act on the pawl when the back assembly is at the upper limit of vertical travel to separate the pawl from the rack and permit downward sliding, i.e. manual lowering of the back assembly to a lowered position. Such height adjusting mechanisms further include actuator parts at the lower end of travel which automatically disengage the lever, pins or the like to release the pawl and permit the pawl to reengage the rack.

Examples of such height adjusting mechanisms are disclosed in U.S. Pat. Nos. 2,405,013, 4,639,039, 5,560,233, 5,649,741 and 5,685,609.

Additionally, it is known to provide gears in a height-adjusting mechanism wherein the gear cooperates with a lock operated by a manual actuator to release and lock the gear which respectively permits and prevents upward movement of a furniture component. An example of one such mechanism is disclosed in U.S. Pat. No. 3,194,187.

It is an object of the invention to provide an inventive height adjusting mechanism which is improved relative to such prior height adjusting mechanisms.

The height adjusting mechanism of the invention is connected between a rigid upright extending upwardly from the seat assembly and an inner shell of the back assembly. The inventive height adjusting mechanism includes a rack plate on one of the back assembly and upright and a gear rotatably supported on the other of the back assembly and upright.

The gear engages the teeth of a vertical rack on the rack plate and rolls along the rack during raising and lowering of the back assembly. The height adjustment assembly includes a lock member that removably engages the gear to prevent rotation of the gear which thereby prevents relative vertical movement of the rack plate since the rack teeth mate with the gear teeth. However, lifting of the back assembly by the chair occupant causes the lock member and the gear to continuously or intermittently separate to allow the gear to roll along the rack. If the back assembly is released, the back assembly tends to want to fall at which time the lock member reengages the gear and prevents rotation thereof.

To permit lowering of the back assembly, the height adjustment mechanism further includes a movable disengagement member which is actuated to separate the gear and lock member at an upper limit of travel and maintains the gear and lock member separated as the back assembly is lowered. The gear is free to roll along the rack during this lowering movement.

At the lower limit of travel, the disengagement member is automatically actuated to permit reengagement of the lock member and the gear. When the lock member and gear are reengaged, the back assembly may be moved upwardly but the cooperating lock member and gear continue to prevent downward movement of the back assembly.

Multiple embodiments of the height adjustment mechanism are disclosed herein. It will be understood that other objects and purposes of the invention, and variations thereof, will be apparent upon reading the following specification and inspecting the accompanying drawings.

Figure 1:
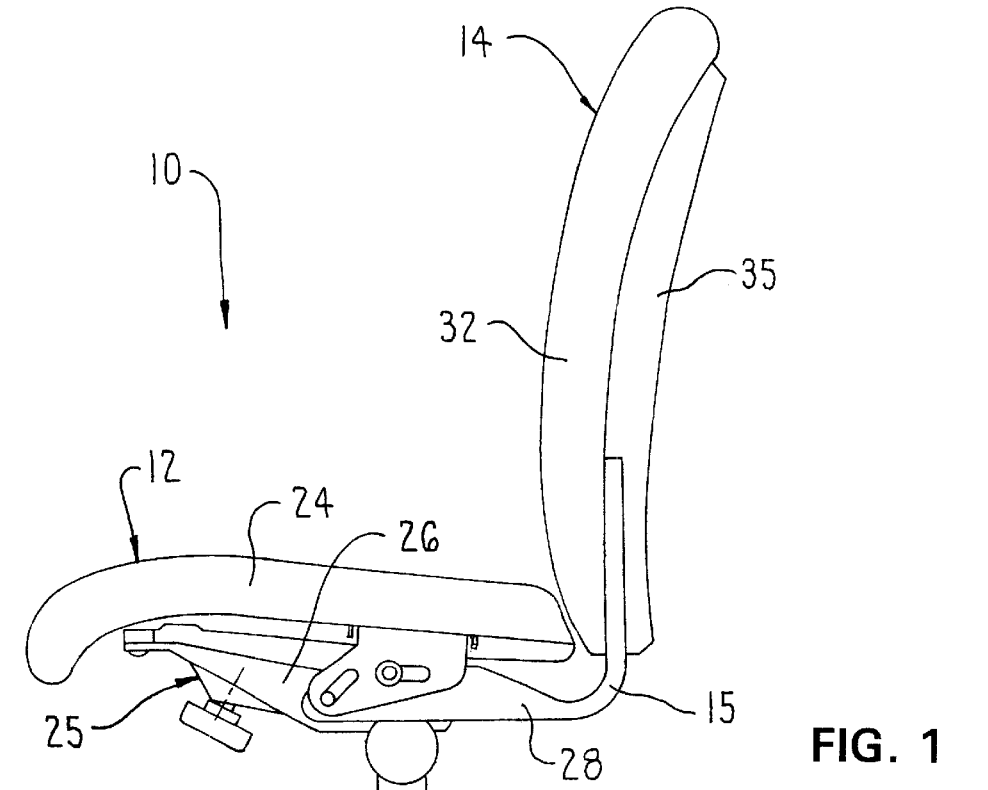
FIG. 1 is a left side elevational view of an office chair.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Figure 2:
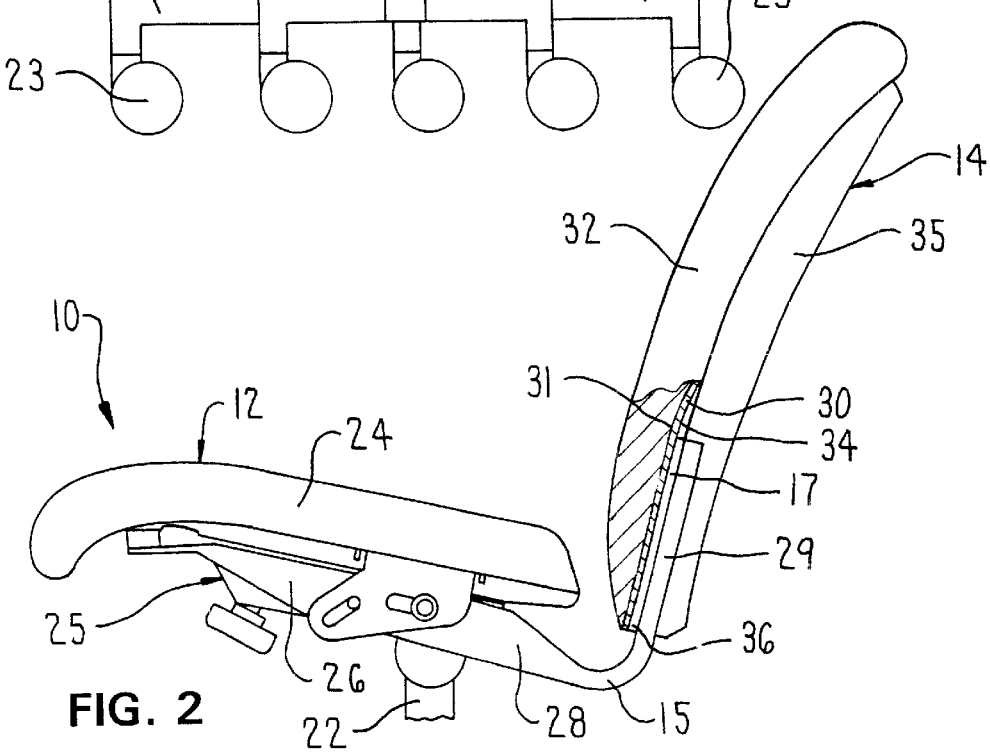
FIG. 2 is a side view of the chair partially broken away to diagrammatically illustrate a height adjustment mechanism in the chair back.

Referring to FIGS. 1 and 2, an office chair 10 is illustrated which includes a seat assembly 12 and a back assembly 14. The seat assembly 12 includes a generally L-shaped upright 15 which projects upwardly above the rear edge of the seat assembly 12 and supports the back assembly 14 thereon. A height adjusting mechanism 17 is diagrammatically illustrated in FIG. 2 connecting the back assembly 14 to the upright 15.

Generally, the office chair 10 includes a base 20 having legs 21 radiating outwardly from a lower end of the vertical pedestal 22. The outer ends of the legs 21 include conventional casters 23 which support the office chair 10 on a floor or other similar surface.

The upper end of the pedestal 22 rigidly supports the seat assembly 12 thereon. In particular, the seat assembly 12 includes a horizontally enlarged seat cushion 24 which seat cushion 24 overlies and is supported on the pedestal 22 by a tilt control mechanism 25. The tilt control mechanism 25 includes a control housing 26 which is rigidly connected to the pedestal 22, and furthermore supports the upright 15 which is pivotally connected thereto.

The upright 15 is rigid and includes a generally horizontal leg 28 and a generally vertical leg 29. The front end of the horizontal leg 28 is pivotally connected to the control housing 26 while the vertical leg 29 extends upwardly from the rear end of the horizontal leg 28. The vertical leg 29 is disposed rearwardly of the seat cushion 24 and supports the back assembly 14 on the upper end thereof. The pivotal connection of the upright 15 to the control housing 26 thereby permits rearward tilting of the back assembly 14 relative to the seat assembly 12 by the chair occupant.

Referring to FIGS. 1–4, the back assembly 14 includes a vertically enlarged plastic inner shell 30 which is covered on the front face 31 thereof by a cushion 32. The back face 34 of the inner shell 30 is covered by a vertically enlarged plastic outer cover 35 which completely covers the inner shell 30 and contacts the back cushion 32 about the periphery thereof to provide a finished appearance to the back assembly 14.

The lower end of the back assembly 14 includes a downward opening space or pocket 36 which pocket 36 generally is defined between back face 34 of the inner shell 30 and an opposing inner face of the cover 35. The pocket 36 is adapted to receive the upper end of the upright 15 therein. As will be discussed in more detail hereinafter, the back assembly 14 is slidable vertically along the upper end of the upright 15 to permit adjustment of the height of the back assembly 14 relative to the seat assembly 12.

The upper end of the upright 15 further includes the height adjustment mechanism 17 which is provided to control adjustment of the vertical height of the back assembly 14 and support the back assembly 14 at a selected elevation. The height adjustment mechanism 17 is supported on the upright 15 and cooperates with the back face 34 of the inner shell 30 to define a connection therebetween. The height adjustment mechanism 17 can be readily adapted for mounting to the opposite side of the upright 15, or even on upright support posts of a chair arm or other body supporting member for cooperation with the inner shell of the armrest housing or body supporting member.

A first embodiment of the height adjustment mechanism is illustrated in FIGS. 3–11 and is designated by reference numeral 17-1. Generally, the height adjustment mechanism 17-1 provides a load-bearing connection between the back assembly 14 and the upright 15 (illustrated in phantom outline), while permitting the elevation of the back assembly 14 (FIGS. 1–2) to be selectively adjusted relative to the seat assembly 12 through manual lifting of the back assembly 14 by the chair user. The height adjustment mechanism 17-1 does not require a separate actuator handle or lever that is exteriorly accessible, but instead actuates automatically merely by raising and lowering the back assembly 14. While this arrangement is preferred, it will also be understood that the height adjustment mechanism 17-1 could be modified to include a manual actuator.

Figure 3:
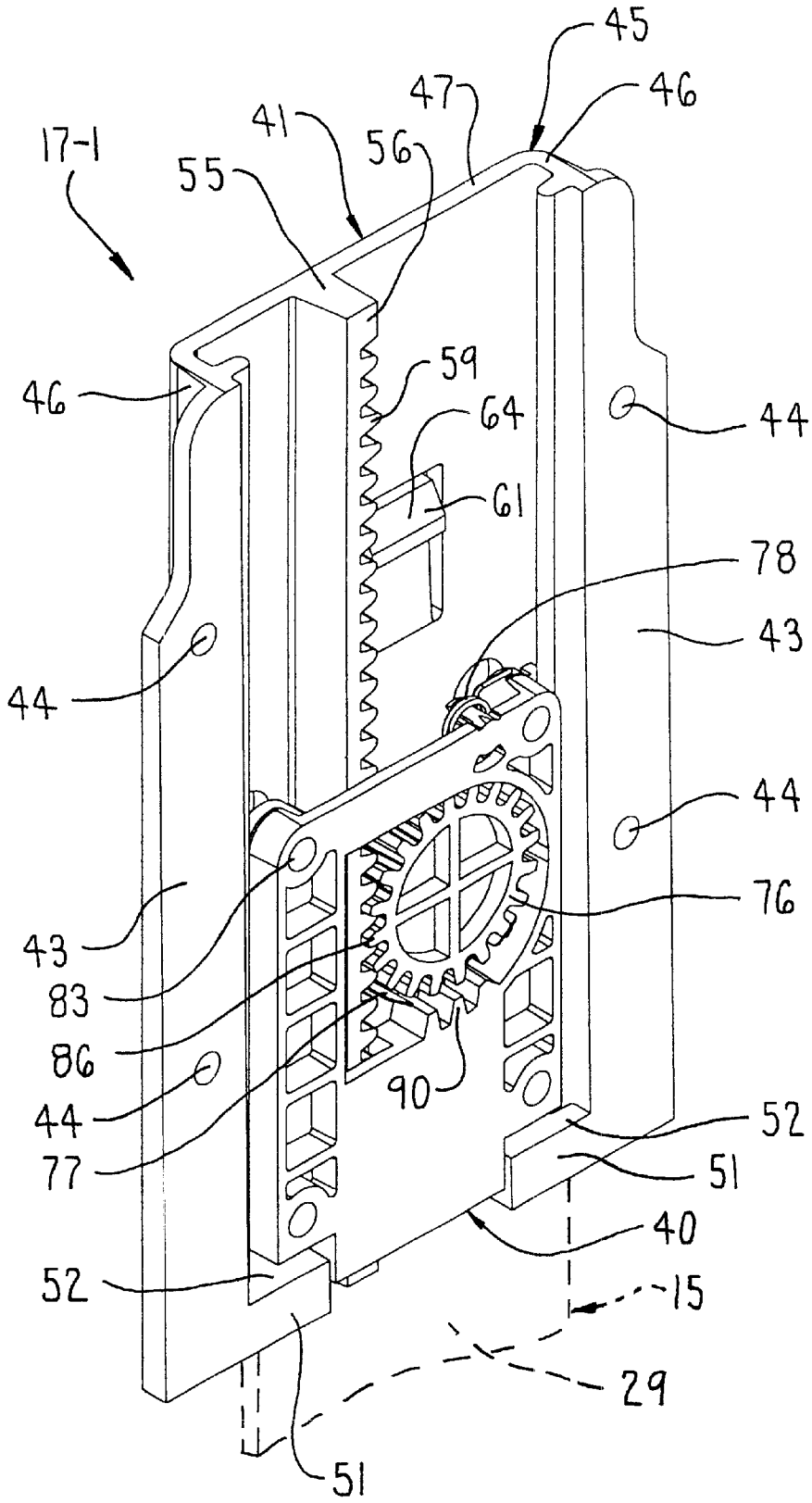
FIG. 3 is a perspective view of a first embodiment of the height adjustment mechanism.
Figure 4:
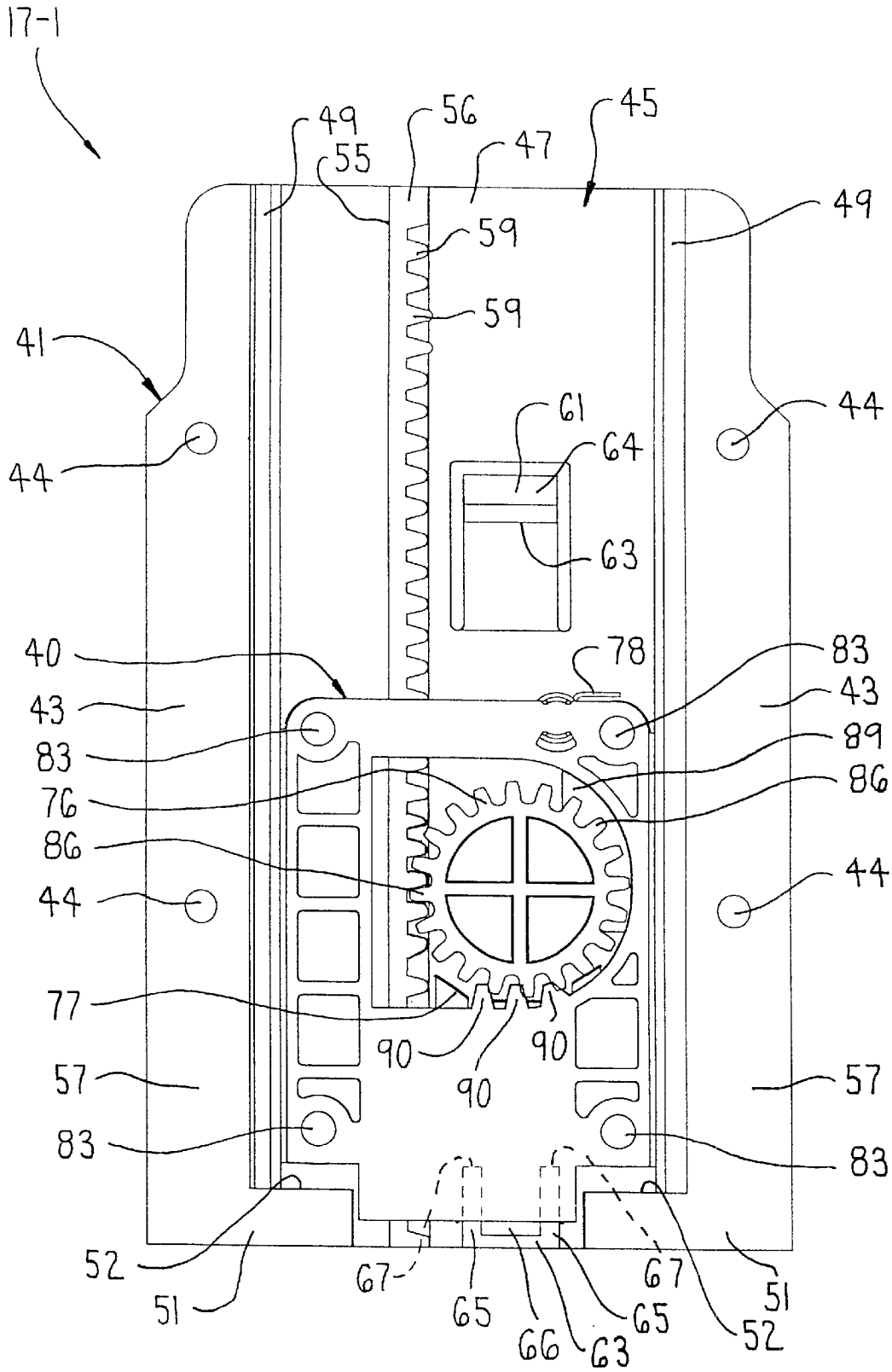
FIG. 4 is a front elevational view of the first height adjustment mechanism.
Figure 5:
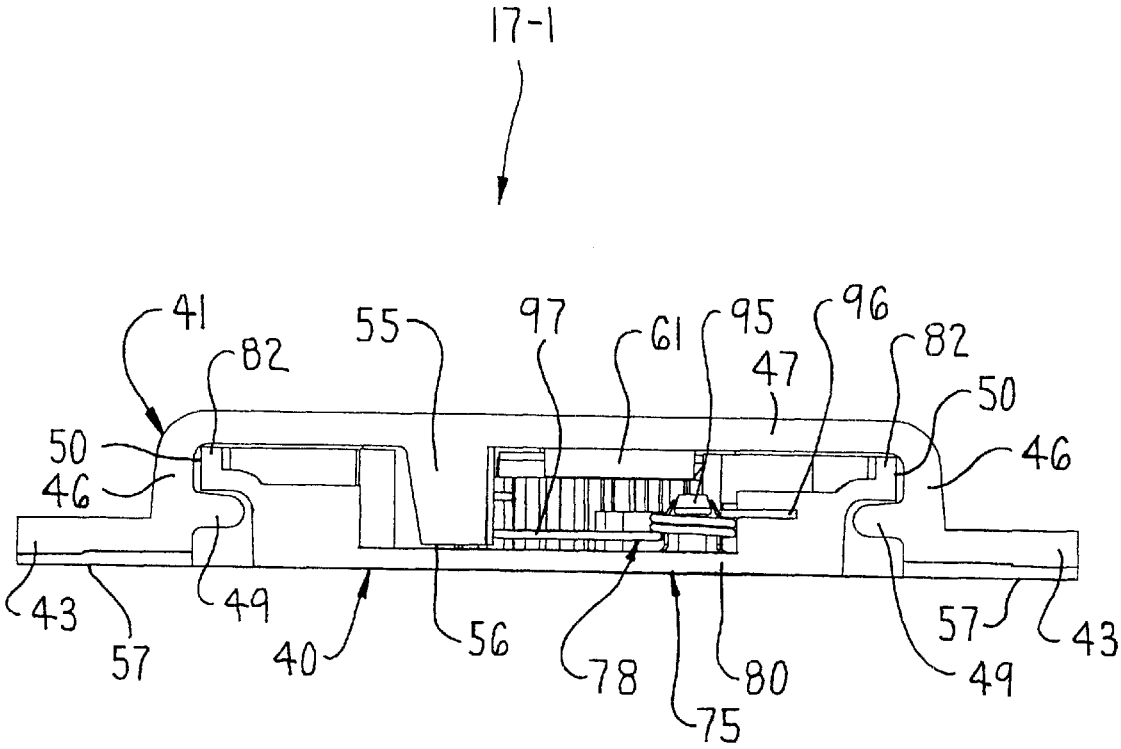
FIG. 5 is a plan view of the height adjustment mechanism.
Figure 6:
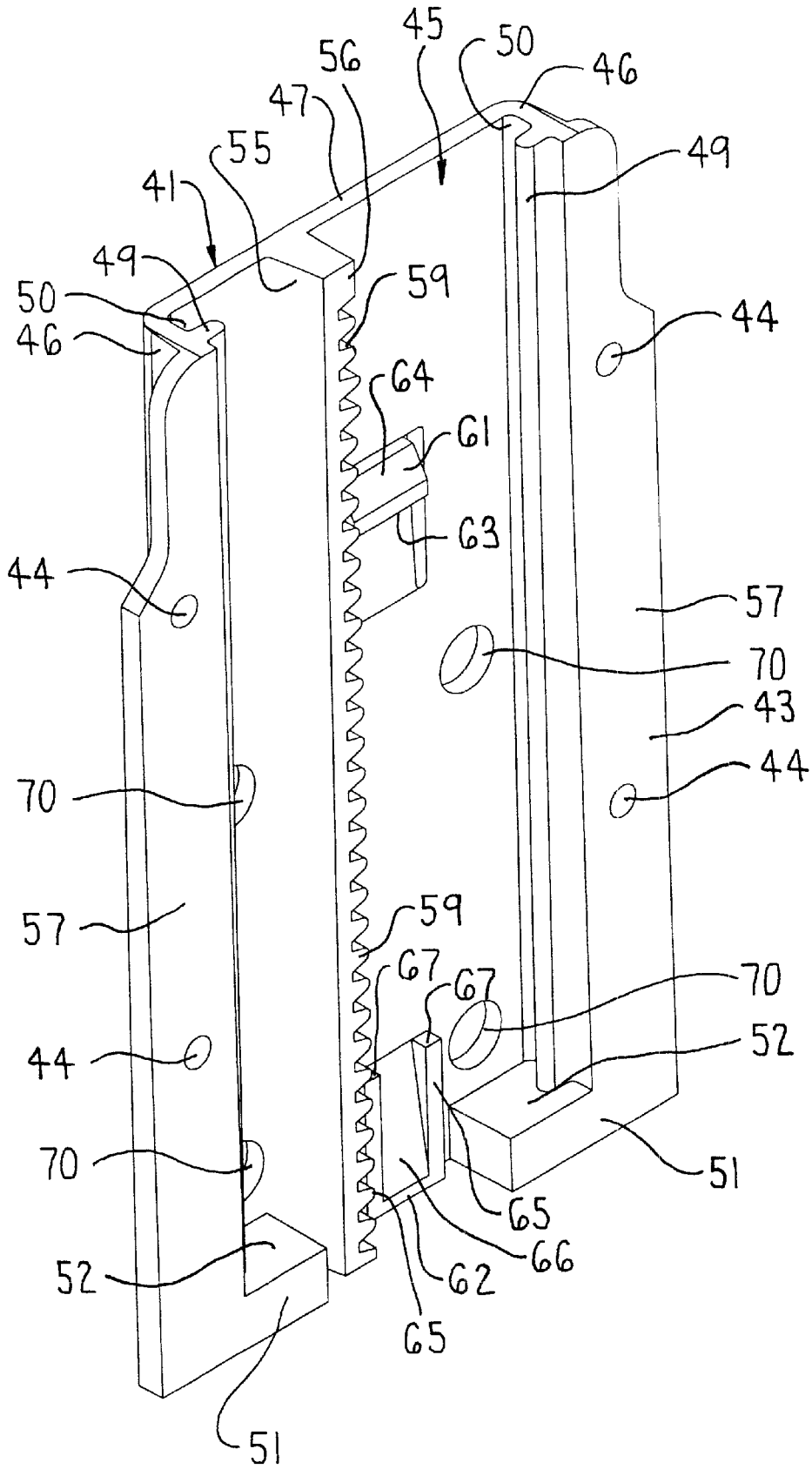
FIG. 6 is a perspective view of a rack plate of the mechanism.

Referring to FIGS. 3–5, the height adjustment mechanism 17-1 includes a gear assembly 40 which mounts to the upright 15, and a rack plate 41 which mounts to the chair shell 30 and is movable therewith. Thus, the gear assembly 40 remains stationary while the rack plate 41 is movable vertically relative thereto.

More particularly as to the individual components, the rack plate 41 (FIGS. 3 and 6) is vertically enlarged and includes a pair of mounting flanges 43 that project sidewardly and define the opposite side edges of the rack plate 41. The mounting flanges 43 include mounting bores 44 projecting horizontally therethrough, through which fasteners are inserted to fasten the height adjustment mechanism 17-1 to the chair shell 30 during final assembly of the chair 10.

The rack plate 41 furthermore is formed with a central guide channel 45 which opens upwardly and is adapted to slidably receive the gear assembly 40 therein. The guide channel 45 is defined by parallel side walls 46 which project from the mounting flanges 43 and a central wall 47 which extends sidewardly or laterally between the side walls 46.

To guide the gear assembly 40 within the guide channel 45, each side wall 46 includes a guide rib 49 which projects sidewardly into the guide channel 45 and extends vertically along most of the length of the side wall 46. The ribs 49 thereby define guide slots 50 between the opposing surfaces of the ribs 49 and the central wall 47 as seen in FIG. 5.

The side walls 46 also include block-like abutments 51 at the bottom ends thereof. The abutments 51 project sidewardly and define upward-facing stop surfaces 52.

The central wall 47 also includes a vertical rack 55 which projects generally parallel to the sidewalls 46. As seen in FIG. 5, however, the end face 56 of the rack 55 terminates a short distance inwardly of the plate faces 57 defined by the mounting flanges 43 to provide a clearance space for the gear assembly 40.

The rack 55 includes a row of teeth 59 extending vertically along the length of the rack 55. The teeth 59 project sidewardly and are vertically spaced apart to define incrementally spaced elevations at which the back assembly 14 is supported by the gear assembly 40 as will be described herein.

To automatically actuate the gear assembly 40 at upper and lower limits of travel, the central wall 47 is formed with an upper actuator block 61 and a lower actuator block 62. The upper actuator block 61 projects from the central wall 47 into the central channel 45, and has a downward facing abutment surface 63 which operate the gear assembly 40 at the lower limit of travel. Further, a beveled edge 64 is defined on an upper surface thereof to facilitate assembly.

As for the lower actuator block 62, the lower block 62 includes a pair of sidewardly spaced apart ribs 65 having an inclined ramp 66 defined therebetween. The upper end faces of the ribs 65 define upward-facing abutment surfaces 67 that operate the gear assembly 40 at the upper limit of travel.

The upper and lower actuator blocks 61 and 62 are aligned one above the other within the central channel 45 and are spaced sidewardly from the rack teeth 59 on one side and a rib 49 on the opposite side which provides sufficient lateral clearance to permit the gear assembly 40 to slide vertically within the central channel 45.

To permit installation onto the chair 10, the central wall 49 also is formed with four access holes 70 which permit tools and fasteners to be inserted therethrough for fastening the gear assembly 40 to the upright 15.

Figure 7:
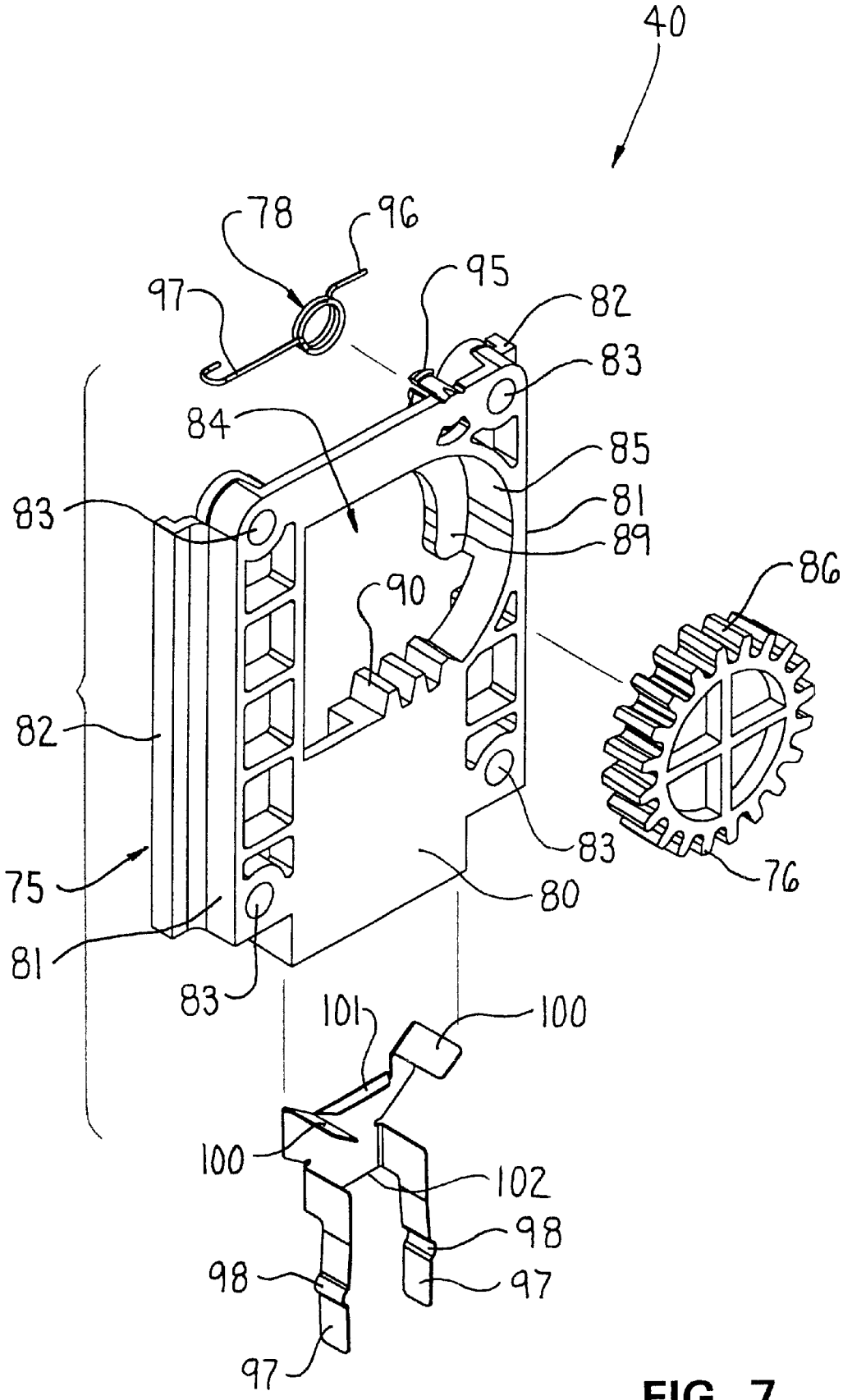
FIG. 7 is an exploded perspective view of a gear assembly.
Figure 8:
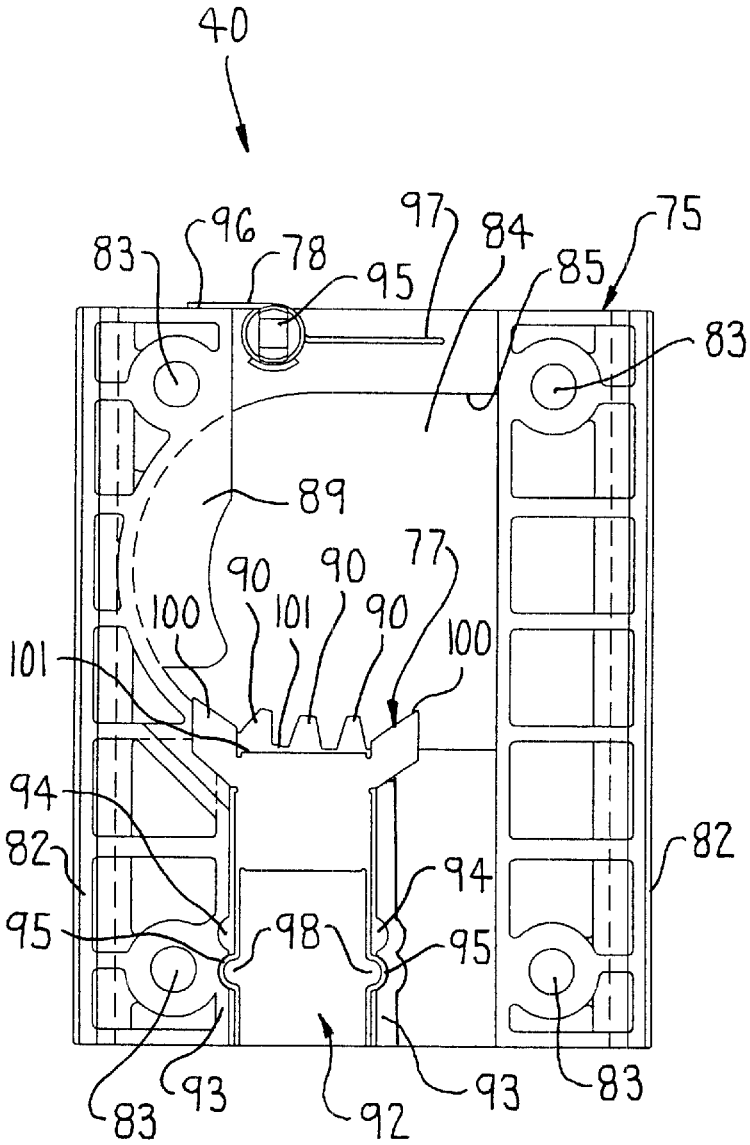
FIG. 8 is a rear view of a gear support plate for a gear.
Figure 10:
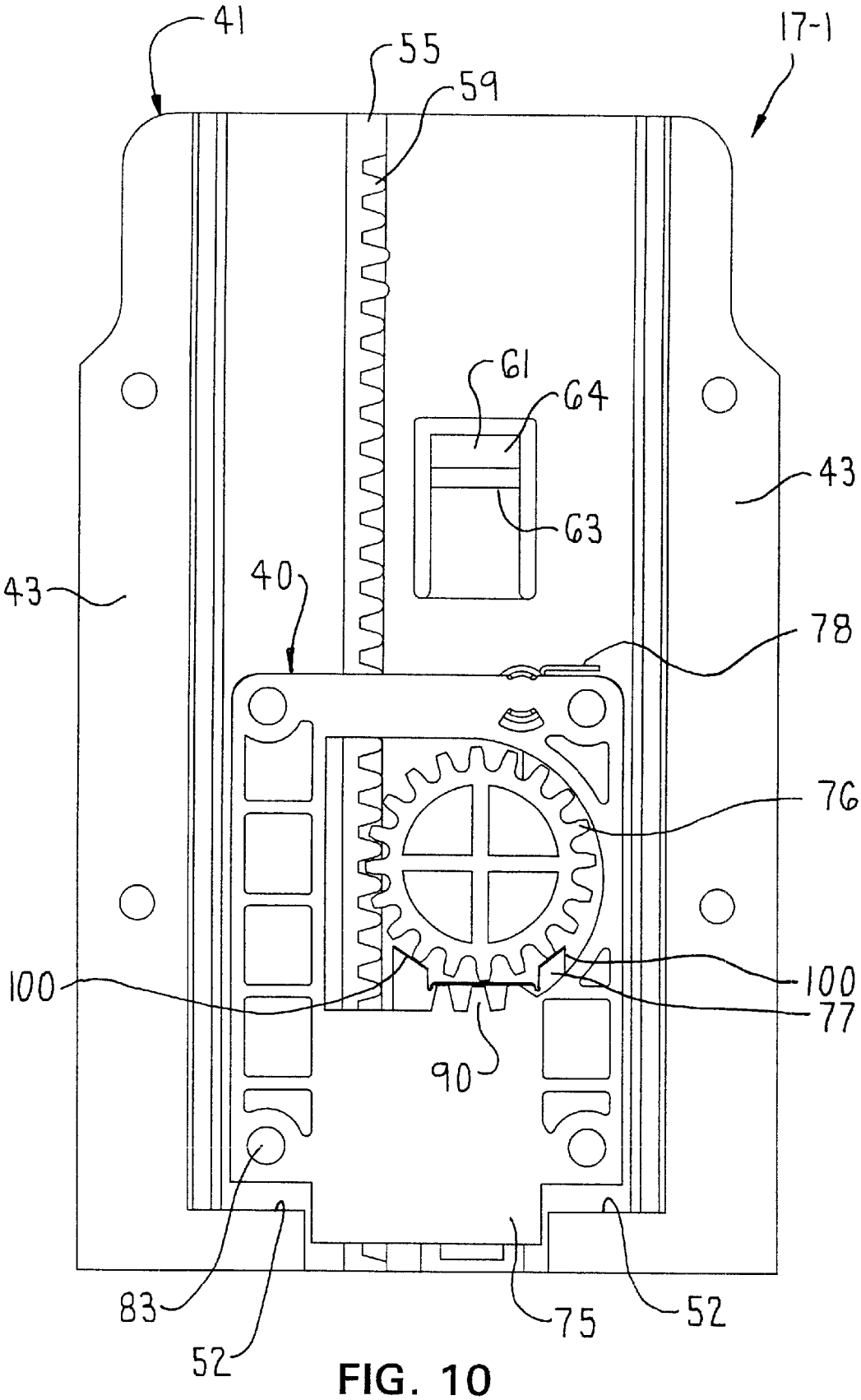
FIG. 10 is a front elevational view of the height adjustment mechanism with the rack plate at an upper limit of travel.

Referring to the gear assembly 40 as seen in FIGS. 4, 7 and 8, the gear assembly 40 includes a gear housing or support plate 75 which supports a gear 76, a disengagement member formed as an actuator clip 77, and a clicker 78 therein.

More particularly, the gear housing 75 includes front wall 80, opposite side walls 81 and edge flanges 82 which project sidewardly from the side walls 81. The side walls 81 are dimensioned so as to fit between the ribs 49 on the rack plate 40 as seen in FIG. 5 wherein the edge flanges 82 project into and slide vertically along the guide channels 50. Thus, when assembled, the cooperating edge flanges 82 and guide channels 50 serve to join the rack plate 40 and gear assembly 41 together while permitting relative vertical movement therebetween.

The front wall 80 also includes four fastener bores 83 which open horizontally therethrough. The bores 83 are located so as to align with the access holes 70 in the rack plate 40. Thus, the rack plate 40 and the gear assembly 41 can be assembled together with the holes 70 and bores 83 aligned with each other. The entire assembly is positioned with the front housing wall 80 abutting against the upright 15, and then fasteners are inserted through the access holes 70 and the bores 83 to fasten the gear assembly 41 to the upright 15. As such, the gear assembly 41 is stationarily supported on the upright 15 while the rack plate 40 can move vertically relative thereto in combination with the back assembly 14.

The housing 75 further includes a gear pocket 84 (FIG. 7) which opens through the front housing wall 80 and rotatably supports the gear 76 therein. The gear pocket 84 includes a peripheral pocket wall 85 which is generally D-shaped and adapted to freely receive the gear 76 therein. When assembled, the flat side of the pocket 84 receives the rack 55 therethrough.

The gear 76 has teeth 86 extending about the circumference thereof, and when the gear 76 is received in the pocket 84 as illustrated in FIG. 4, the gear teeth 86 mesh with or engage the rack teeth 59 on one side and are confined laterally on the opposite side by the pocket wall 85. As a result, the gear 76 is rotatable within the pocket 84 wherein vertical movement of the rack 55 causes the gear 76 to rotate about a horizontal axis.

To trap the gear 76 in the pocket 84, a retainer flange 89 (FIGS. 7 and 8) is formed in the curved portion of the pocket wall 85 whereby the gear 76 is confined between the pocket wall 85 and the upright 15. Thus, the gear 76 floats freely within the pocket 84 without any direct fixed connections being formed therebetween.

Figure 11:
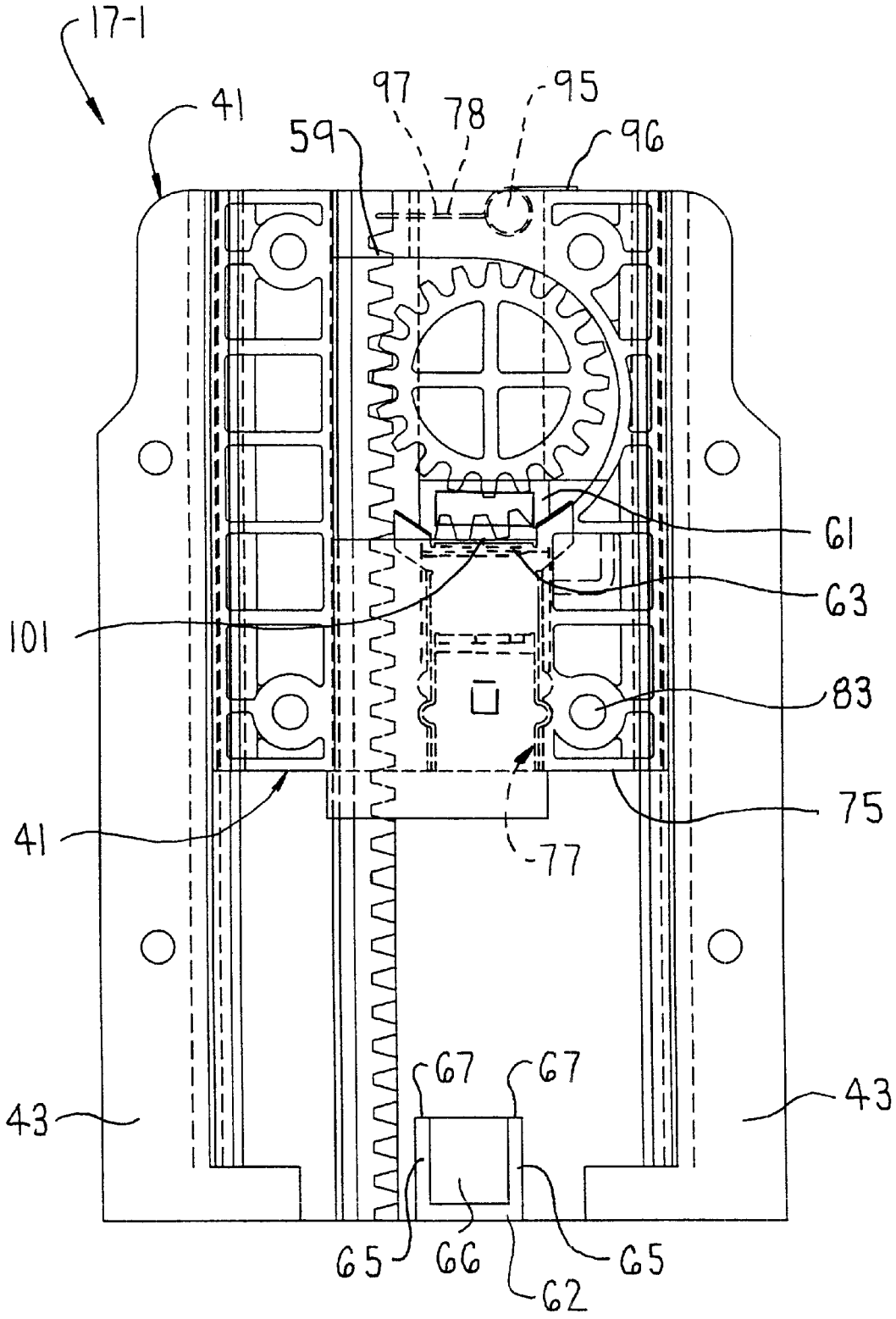
FIG. 11 is a front elevational view of the height adjustment mechanism with the rack plate at a lower limit of travel.

Referring to FIG. 4, the pocket wall 85 also has a vertical dimension which is greater than the outer diameter of the gear 76. As a result, upward movement of the rack plate 41 pulls or shifts the gear 76 upwardly to the top edge of the pocket wall 85 as seen in FIGS. 3 and 11. Also, downward movement of the rack plate 41 pulls the gear 76 downwardly to the bottom of the pocket 84 as seen in FIG. 4, such as when the back assembly 14 is released by the user and the weight thereof urges the rack plate 41 downwardly,.

To prevent the back assembly from dropping, the bottom section of pocket wall 85 includes lock members, namely rack-like locking teeth 90. The locking teeth 90 are adapted to mesh with the gear teeth 86 which occurs when the user releases the back assembly 14. The rack 55 thereby shifts the gear 76 downwardly into engagement with the locking teeth 90 under the weight of the back assembly 14. The locking teeth 90 prevent further rotation of the gear 76 which thereby prevents further downward movement of the back assembly. As such, the meshed engagement of the rack teeth 59 and the gear teeth 86 support the weight of the back assembly 14. When the back assembly 14 is raised, however, the gear 76 is shifted upwardly to the unlocked rotatable position within the pocket 84.

While this permits raising of the back assembly 14, the actuator clip 77 is also provided to permit lowering of the back assembly 14. As described herein, the actuator clip 77 maintains the gear 76 in the raised disengaged position during lowering of the back assembly 14.

In this regard, the front housing wall 80 includes a clip slot 92 (FIG. 8) which is formed on the inside thereof directly below the locking teeth 90 and the gear 76. The clip slot 92 opens vertically and is defined by vertical slot walls 93 that are formed as mirror images of each other. Each slot wall 93 is formed with two vertically-adjacent recesses 94 and 95 respectively.

Referring to FIGS. 7 and 8, the actuator clip 77 itself is formed of resilient spring steel and has a pair of guide legs 97 which extend downwardly. The clip also may be formed of plastic. The guide legs 97 are slidably received within the clip slot 92 and each include a detent 98 which detents 98 are received either in the upper recesses 94 or the lower recesses 95.

The actuator clip 77 also includes a pair of support flanges 100 which extend horizontally and are inclined opposite to each other to rotatably support the gear 76 thereon. Additionally, the clip 77 includes a lip 101 located between the support flanges 100. When viewed from the side as seen in FIG. 9, a clip edge 102 is defined below the lip 101.

The actuator clip 77 is normally seated in the clip slot 92 in an inoperative position with the detents 98 biased into the lower recesses 95 as seen in FIG. 8 by the resiliency of the legs 97. The support flanges 100 are disposed below the locking teeth 90 and the gear 76 operates as described above, specifically, the gear 76 floats upwardly and rotates as the back assembly 14 is raised and then meshes with the locking teeth 90 when the back assembly 14 is released. As a result, the back assembly 14 is maintained at a selected elevation relative to the seat assembly 12.

Figure 9:
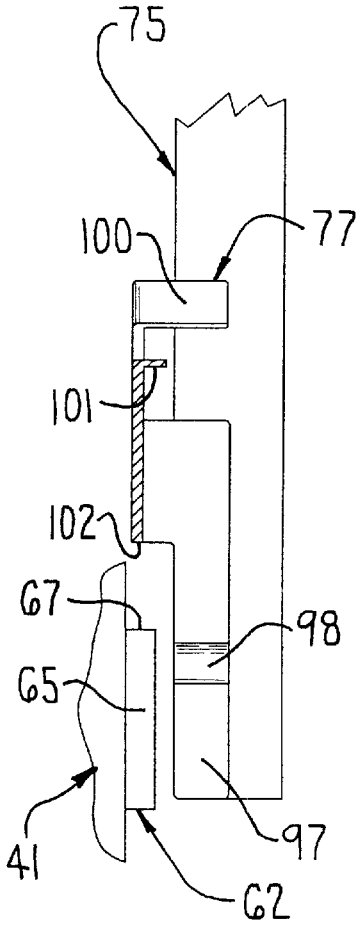
FIG. 9 is a side cross sectional view of the height adjustment mechanism illustrating a disengagement clip for disengaging the gear to permit lowering of the back assembly.

However, as the rack plate 14 moves to the upper limit of travel, the lower actuator block 62 moves upwardly with the abutment surface 67 thereof contacting the lower clip edge 102 as illustrated in FIG. 9. This thereby causes the actuator clip 77 to slide upwardly along the clip slot 92 to the operative position illustrated in FIG. 10. The back assembly 14 cannot be raised further since the stop surfaces 52 of the rack plate 41 contact the bottom edge of the gear housing 75.

The clip 77 is held in the raised operative position by engagement of the detents 98 with the upper recesses 94. As a result, the gear 76 supported on the support flanges 100 is still freely rotatable but is prevented from shifting back down into engagement with the locking teeth 90, whereby the back assembly 14 can be lowered to its bottom limit of travel.

Nearing the bottom limit, the upper actuator block 61 moves downwardly with the rack plate 40 until the abutment surface 63 strikes downwardly onto the top lip 101 of the clip 77. This causes the clip 77 to automatically shift downwardly or snap back to the inoperative position of FIG. 8 wherein the detents 98 reengage the lower recesses 95. At this time, the gear 76 again is engagable with the locking teeth 90 so that the back assembly 14 can be raised to a selected elevation and maintained at this height.

This arrangement as described above operates smoothly due to the rolling gear 76 without any noise being created thereby. However, the clicker 78 has been provided to recreate the sound of a ratchet mechanism.

In particular, the inside of the front housing wall 80 includes a post 95 (FIGS. 8 and 11) to which a circular portion of the clicker 78 is snap fittingly connected. The clicker 78 has a restraining leg 96 which lies on the top edge of the housing 75 to prevent rotation of the clicker 78 during lifting of the back assembly. The clicker 78 also includes a hooked resilient leg 97 which engages the teeth 59 of the rack 55 and creates a clicking sound as the resilient leg 97 ratchets along the teeth 59 of the rack 55 during lifting.

The above-described arrangement provides a smooth height adjustment mechanism which does not require manual actuators to operate but instead operates automatically.

A second embodiment of the invention is illustrated in FIGS. 12–17 and is identified by reference numeral 17-2. Generally, the height adjustment mechanism 17-2 operates substantially the same as the height adjustment mechanism 17-1 except that the disengagement member is a pivotable actuator lever 110 rather than the slidable actuator clip 77.

In particular, the height adjustment mechanism 17-2 includes a rack plate 111 having edge flanges 112 for fixing the rack plate 111 to the chair upright. The rack plate 111 further includes guide slots 113 for guiding a gear assembly 114, and a vertical rack 115 which has vertically spaced apart rack teeth 116.

Figure 14:
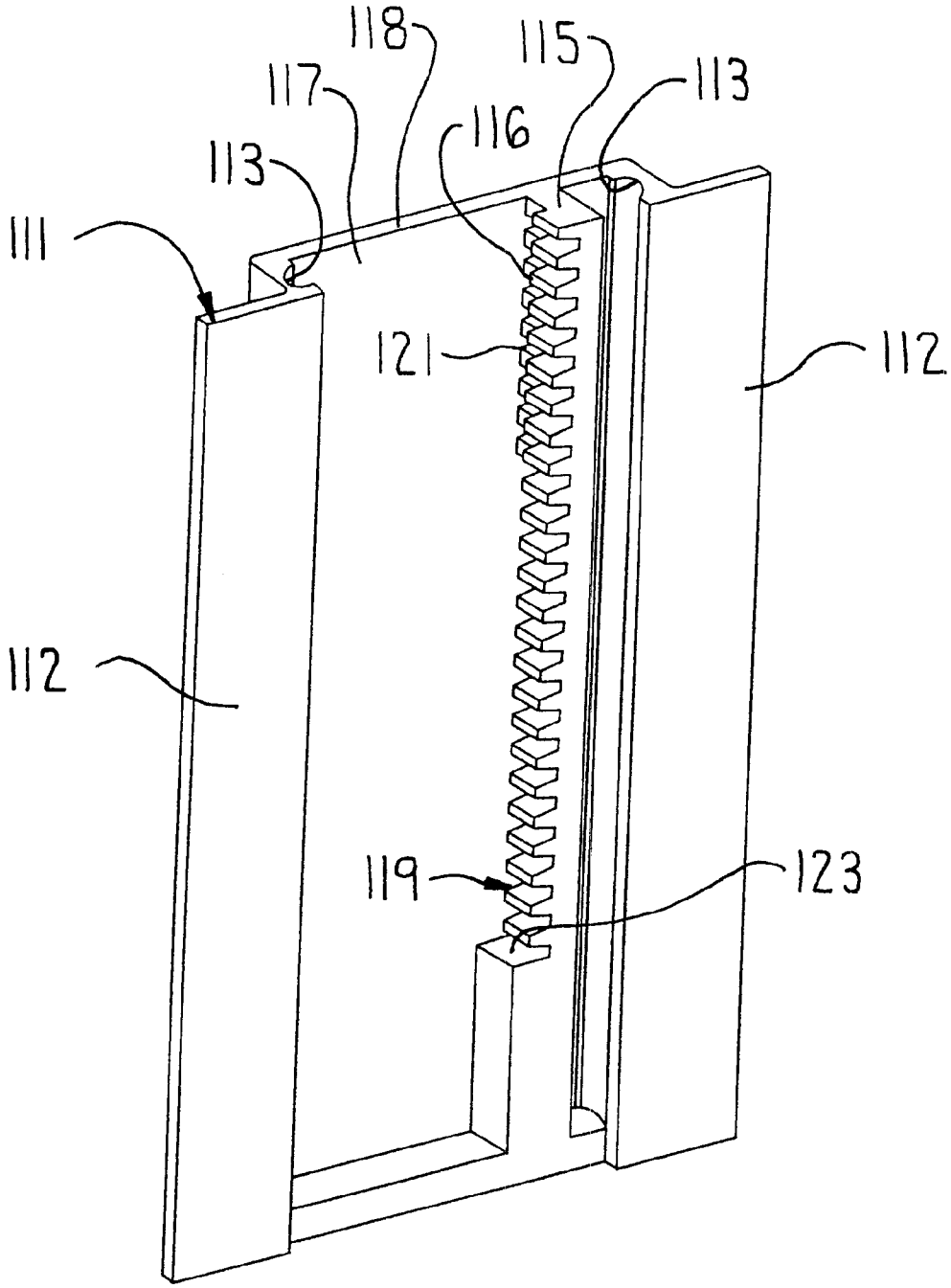
FIG. 14 is a front perspective view of the rack plate.

To actuate the lever 110, the rack teeth 116 are spaced apart from the inside face 117 of the plate wall 118 to define a vertical clearance slot 119 therebetween as seen in FIG. 14. At an upper end of the slot 119, a plurality of reduced height tooth portions 121 are provided within the slot 119. The tooth portions 121 project in the same sideward direction as the rack teeth 116 a sufficient distance to contact the lever 110 at the lower limit of travel as discussed herein. The tooth portions 121, however, are shorter than the rack teeth 116 to permit sliding of the gear assembly 114 into the guide slots 113 when assembling the height adjustment mechanism 17-2.

In addition to the tooth portions 121 which act on the lever 110 at the lower limit of travel, the rack 115 also includes a stop surface 123 at the bottom of the row of teeth 116 which acts on the lever 110 at the upper limit of travel.

As to the gear assembly 114, a housing 124 is provided which includes guide ribs 125 along the opposite vertical side edges of the housing 124. The guide ribs 125 slide vertically in the guide slots 113 of the rack plate 111 to permit relative vertical movement during raising and lowering of a chair back assembly.

The housing 124 also includes a gear pocket 126 which is generally D-shaped and includes locking teeth 127 on a bottom portion thereof. A gear 129 is rotatably received in the pocket 126 and has gear teeth 130 which engage the rack teeth 116.

Figure 12:
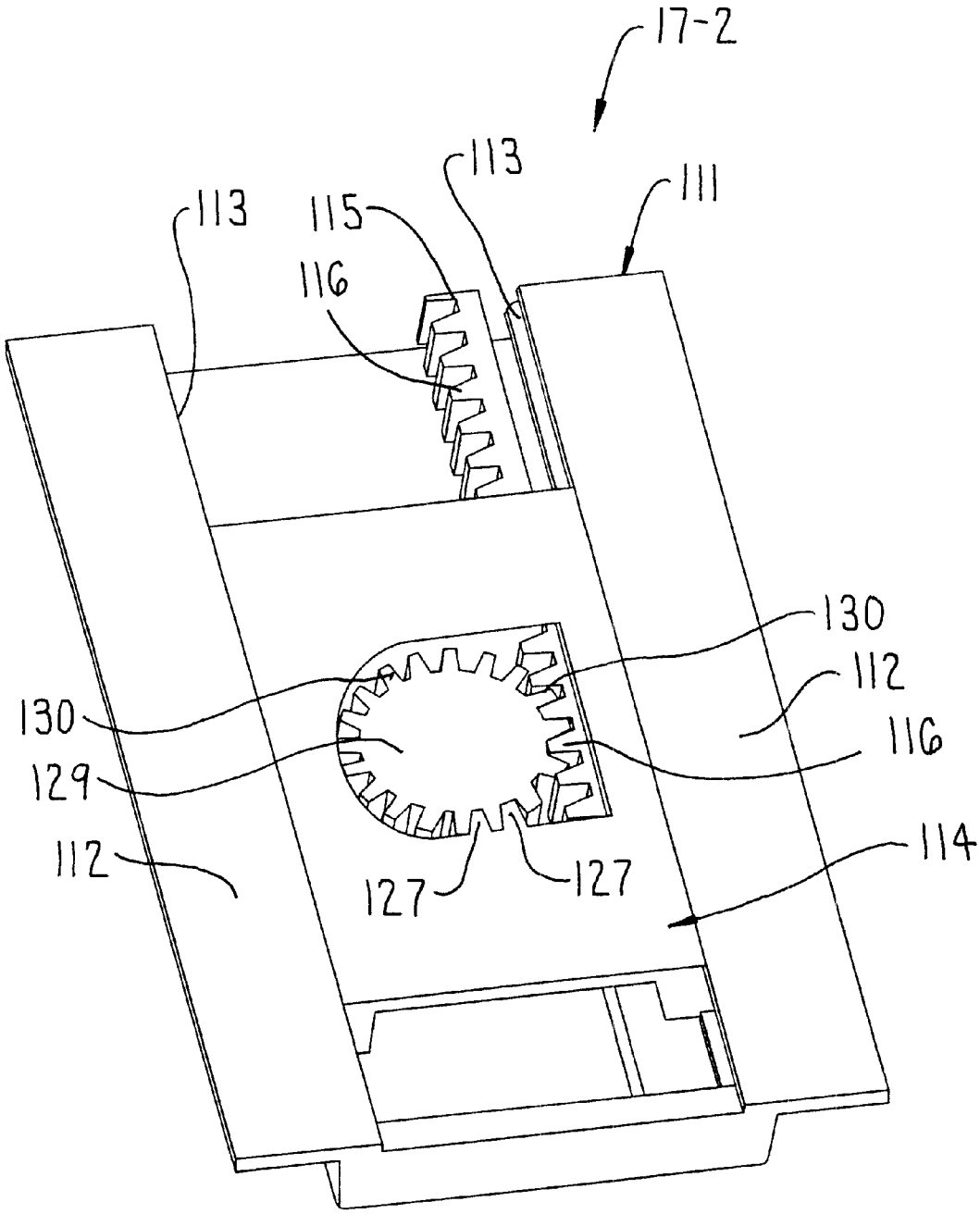
FIG. 12 is a perspective view of a second embodiment of the height adjustment mechanism as viewed from the bottom front.
Figure 15:
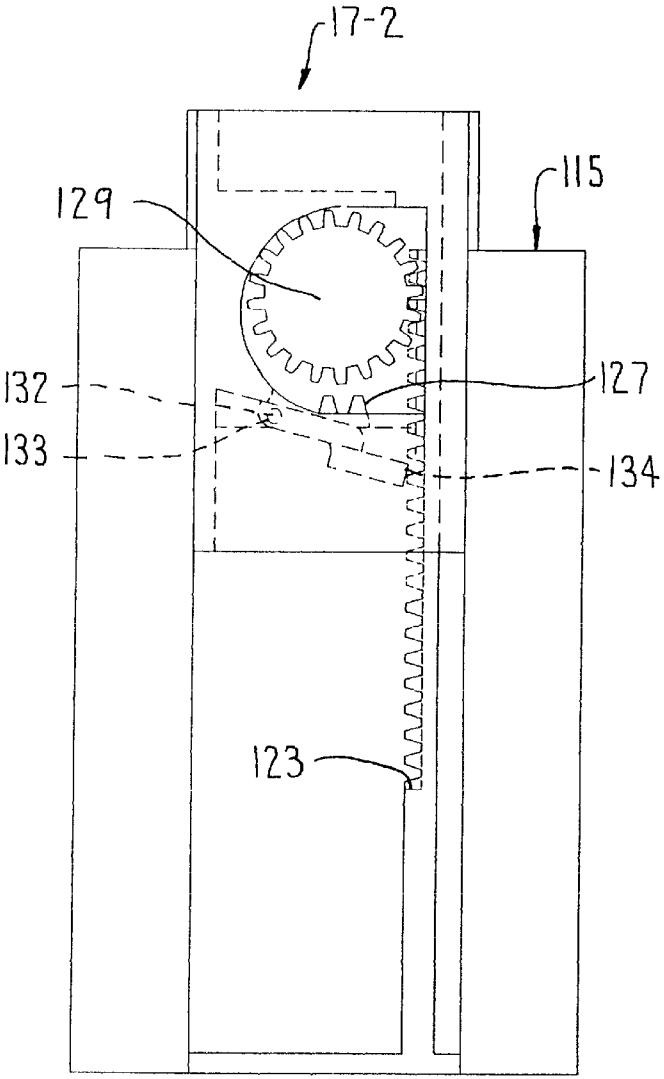
FIG. 15 is a front elevational view of the height adjustment mechanism with the rack plate at a lower limit of travel.

The pocket 126 permits the gear 129 to shift upwardly out of engagement from the locking teeth 127 as the rack plate 111 is moved upwardly in combination with the back assembly as seen in FIG. 15 and as described previously relative to the first embodiment. As a result, the gear 129 rolls along the rack 115. When the back assembly is released or dropped, the rack 115 pulls the gear 129 downwardly back into engagement with the locking teeth 127 as illustrated in FIG. 12.

Figure 13:
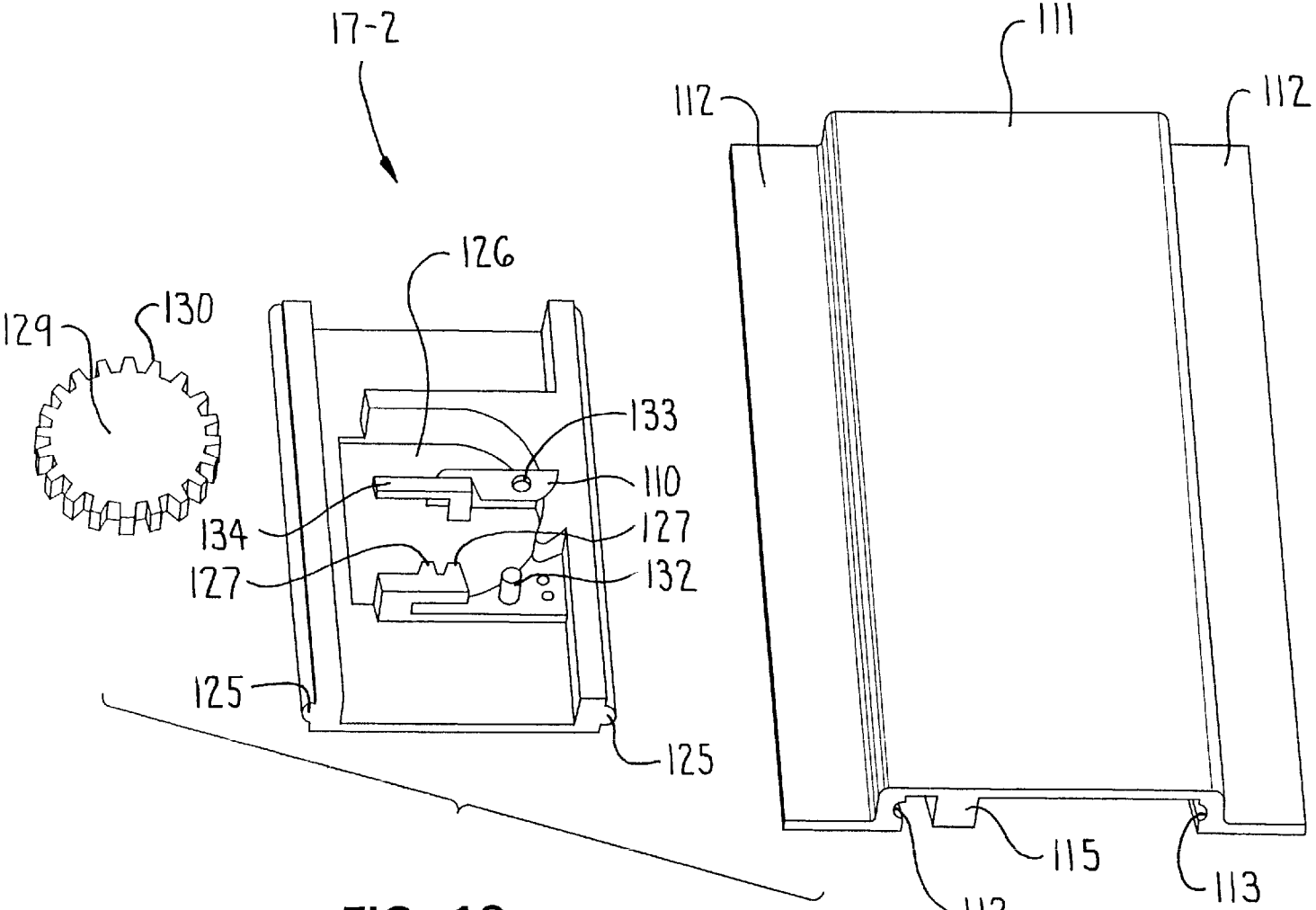
FIG. 13 is an exploded rear view of a rack plate and gear assembly of the second height adjustment mechanism.

To permit lowering of the back assembly, the actuator lever 110 is pivotally supported on the housing 124 by a pivot support pin 132 as seen in FIGS. 13 and 15. The lever 110 includes a pivot bore 133 which is rotatably seated on the pin 132. The lever 133 further includes a distal end 134 which slides along the clearance slot 119.

Figure 17:
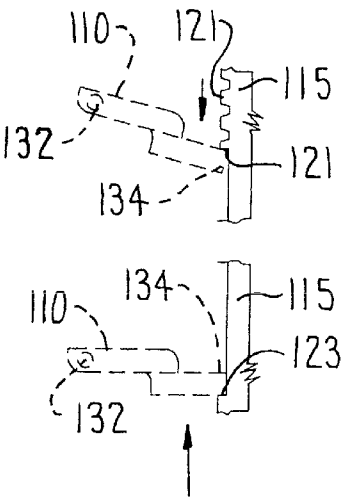
FIG. 17 is a diagrammatic front view of a disengagement lever cooperating with the rack plate for releasing the gear.
Figure 16:
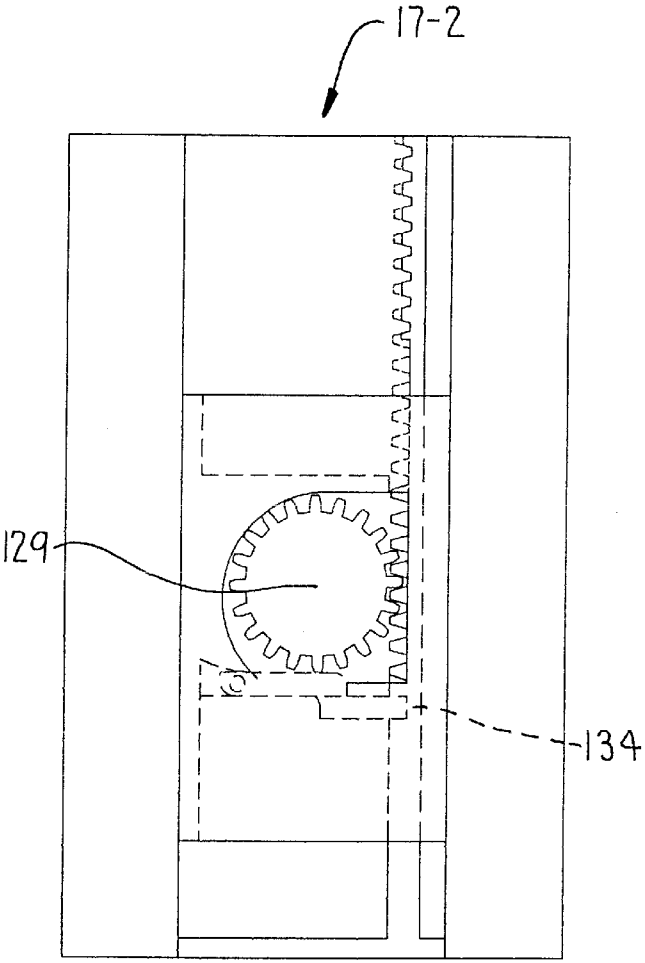
FIG. 16 is a front elevational view of the height adjustment mechanism with the rack plate at an upper limit of travel.

During lifting of the back assembly or when fixed at a selected height, the lever 110 is in the downwardly pivoted inoperative position illustrated in FIG. 15. However, at the upper limit of travel as seen in FIG. 17, the abutment surface 123 strikes the distal end 134 of the lever 110 to pivot the lever 110 upwardly to the operative disengagement position wherein vertical shifting of the gear 129 within the pocket 126 is prevented as seen in FIGS. 16 and 17. In particular, the lever 110 holds the gear 129 in the raised position of FIG. 16 out of engagement with the locking teeth 127. The gear 129 thereby is able to roll unrestrained along the rack 115 when the rack plate 111 and attached back assembly are lowered.

At the lower limit of travel, the tooth portions 121 contact the distal end 134 of the lever 110 to pivot the lever downwardly about the pin 132 as seen in FIGS. 15 and 17 such that the gear 129 again cooperates with the locking teeth 127. As can be seen, the height adjustment mechanism 17-2 operates substantially the same as the first height adjustment mechanism 17-1 discussed above. However, a clicker is not provided such that the mechanism 17-2 provides a smooth quiet operation.

A third embodiment of the height adjustment mechanism is diagrammatically illustrated in FIGS. 18–23 and is identified by reference numeral 17-3. In this embodiment a free floating gear arrangement is again provided although the gear 140 in this embodiment moves in combination with the back assembly.

More particularly, the height adjustment mechanism 17-3 includes a rack plate 141 which is mounted on an upright or other fixed structure on a chair so as to be stationary during adjustment of the height of the back assembly or other body supporting chair component such as a chair arm.

Figure 18:
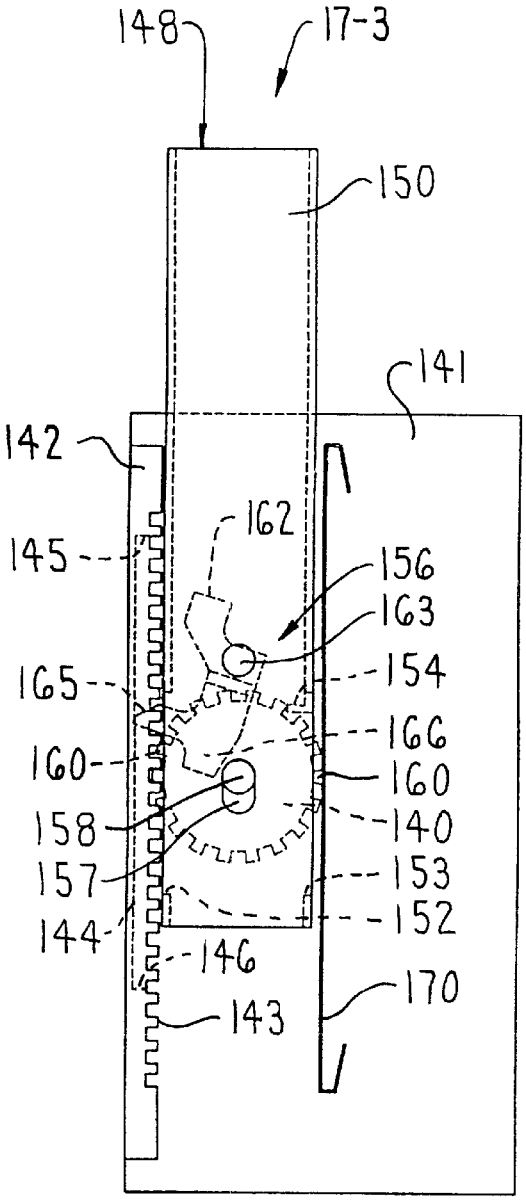
FIG. 18 is a front elevational view of a third embodiment of the height adjustment mechanism illustrating a gear engaged with a locking member.
Figure 23:
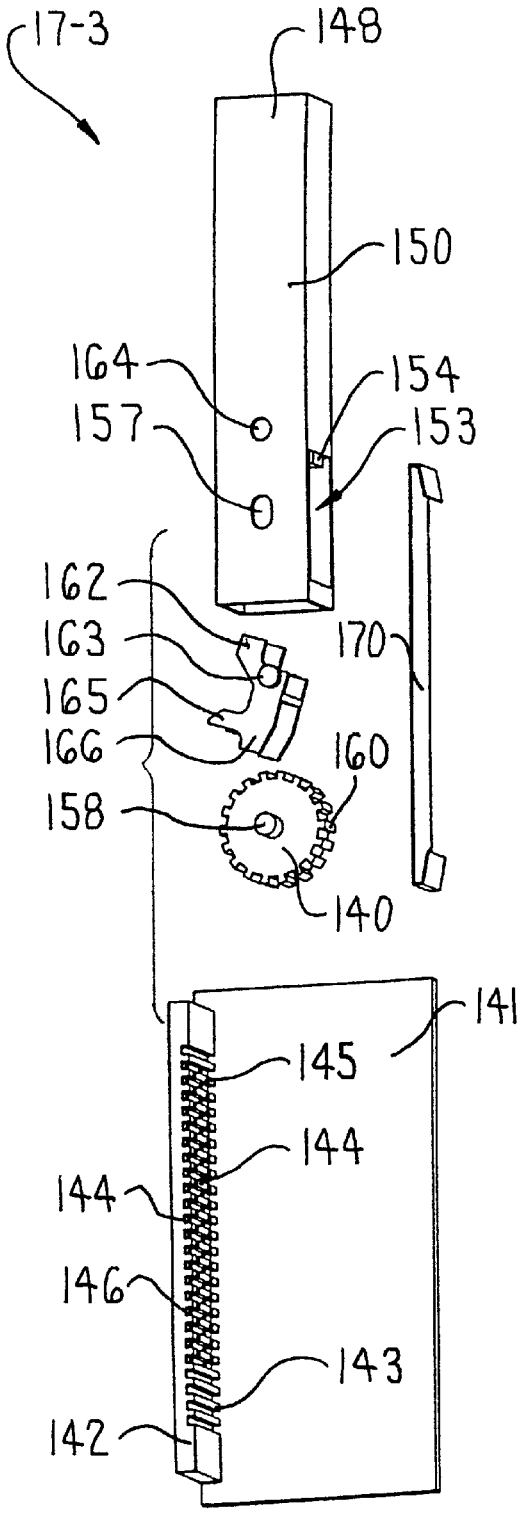
FIG. 23 is an exploded perspective view of the rack plate and gear assembly of the third height adjustment mechanism.
Figure 24:
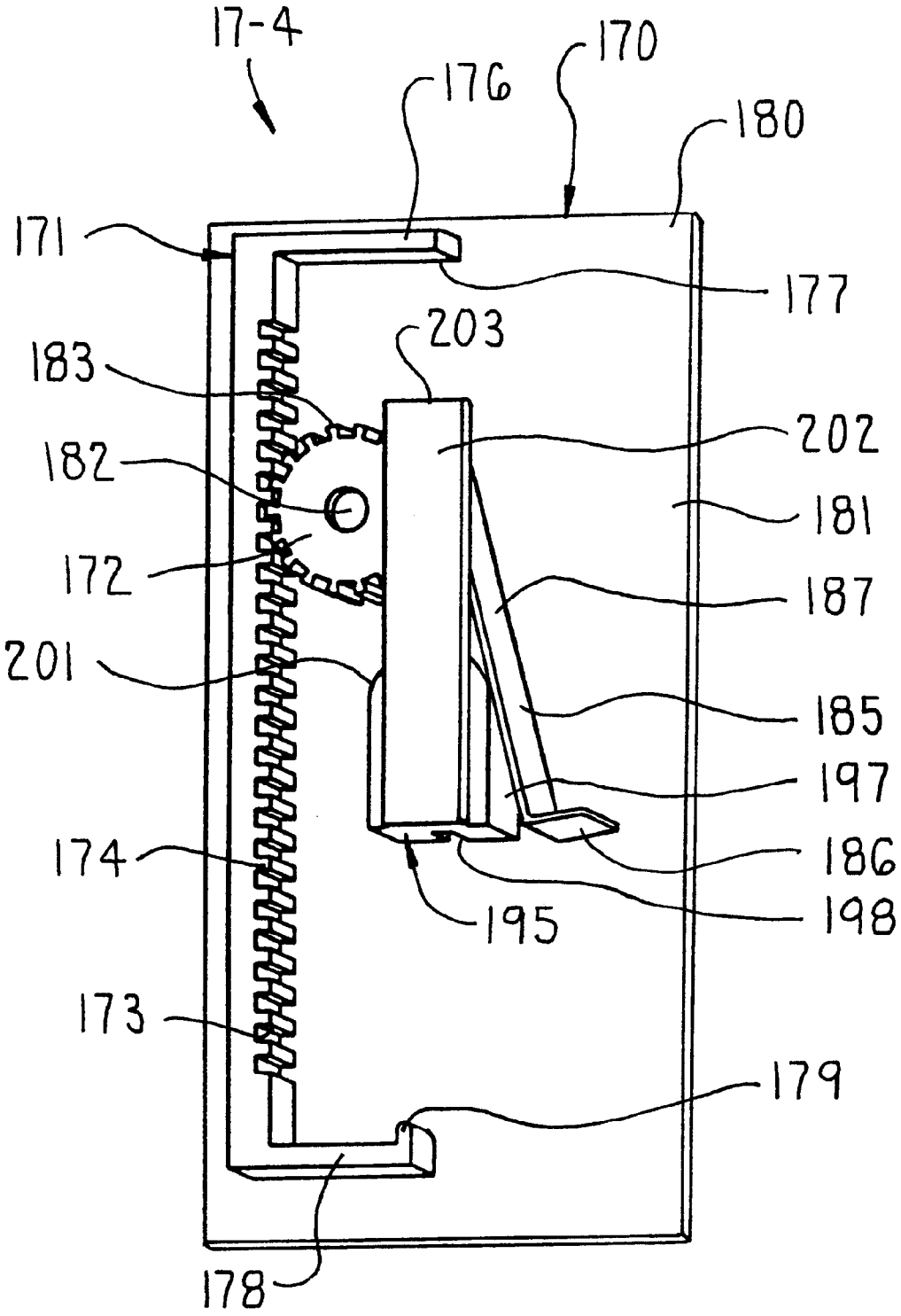
FIG. 24 is a perspective view of a rack member and gear assembly of a fourth embodiment of the height adjustment mechanism.

The rack plate 141 includes a vertically elongate rack 142 having vertically spaced apart rack teeth 143. As illustrated in FIGS. 18 and 23, the rack 142 also includes a parallel pair of vertical clearance slots 144 having upper and lower abutment surfaces 145 and 146 defined respectively at the upper and lower ends of the slots 144.

The height adjustment mechanism 17-3 also includes a gear assembly 148 which is vertically slidably engaged with the rack plate 141. The gear assembly 148 is fixed to and moves vertically with, for example, a back assembly of the chair.

The gear assembly 148 includes a tubular housing 150 which has a square cross-section and a hollow interior 151 to receive the gear 140 therein. More particularly, the housing 150 includes a pair of gear openings 152 and 153 which open through the opposite side walls of the housing 150. The upper edge of the opening 153 also includes a locking projection 154 which projects inwardly.

The region of the hollow interior 151 between the gear openings 152 and 153 effectively define a gear pocket 156 in which the gear 140 is rotatably supported. Specifically, the housing 148 includes a pair of vertically elongate slots 157 which are disposed in opposite walls of the housing 148 in horizontal alignment. The gear 140 includes axle pins 158 which project axially from the opposite side faces thereof and define the pivot axis about which the gear 140 rotates. The axle pins 158 are received in the slots 157 so as to be both rotatable and vertically slidable within the slots 157.

When secured in the gear pocket 156, the gear 140 has its gear teeth 160 projecting in opposite directions through the opposite openings 152 and 153. On the side adjacent the rack 142, the gear teeth 160 mesh with the rack teeth 143 and the gear 140 thereby operates substantially the same as the gears of the first two embodiments described above.

Figure 19:
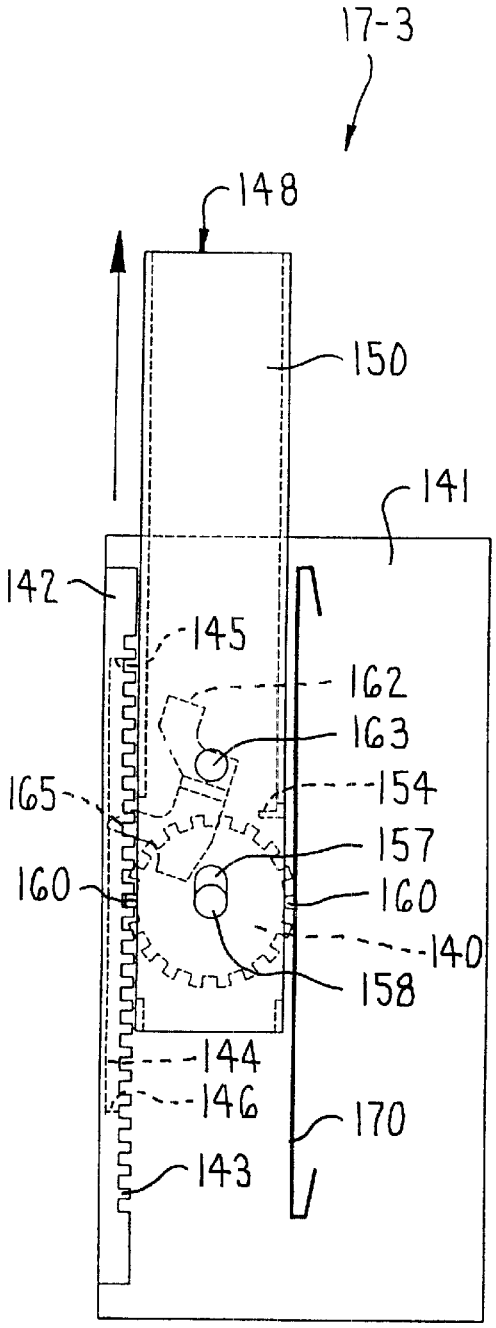
FIG. 19 is a front view of the third embodiment as the chair component, such as a back assembly, is being raised.

The primary difference in the height adjustment mechanism 17-3 is that lifting of a back assembly causes the gear housing 150 to be lifted upwardly, thus, causing the axle pins 158 to shift upwardly to the lower end of the slots 157 due to the cooperation of the gear 140 with the rack 142. In this position, the gear 140 is separated vertically from the locking projection 154 as illustrated in FIG. 19.

However, when the housing 150 is allowed to drop, the gear 140 shifts upwardly along the slots 157 to the position illustrated in FIG. 18, in which position the locking projection 154 engages the gear teeth 160. As a result, rotation of the gear 140 is prevented, thus maintaining the back assembly at a selected elevation.

To permit lowering of the back assembly, a disengagement lever 162 is provided within the hollow housing interior 151, vertically above the gear 140. The lever 162 includes pivot pins 163 on the opposite sides thereof which engage corresponding bores 164 formed in the housing walls.

The lever 162 further includes actuator fingers 165 which project sidewardly, and a bottom end 166 which faces downwardly. The fingers 165 are slidable within the slots 144 formed in the rack 142 to actuate the lever 162 as described hereinafter.

In particular, during lifting of the back assembly, the housing 150 moves upwardly while the actuator fingers 165 project sidewardly through the housing opening 152 into sliding engagement with the rack slots 144 as seen in FIG. 19. The lever 162 in this position is pivoted away from the gear 140 such that the gear 140 and locking projection 154 cooperate as described above.

Figure 20:
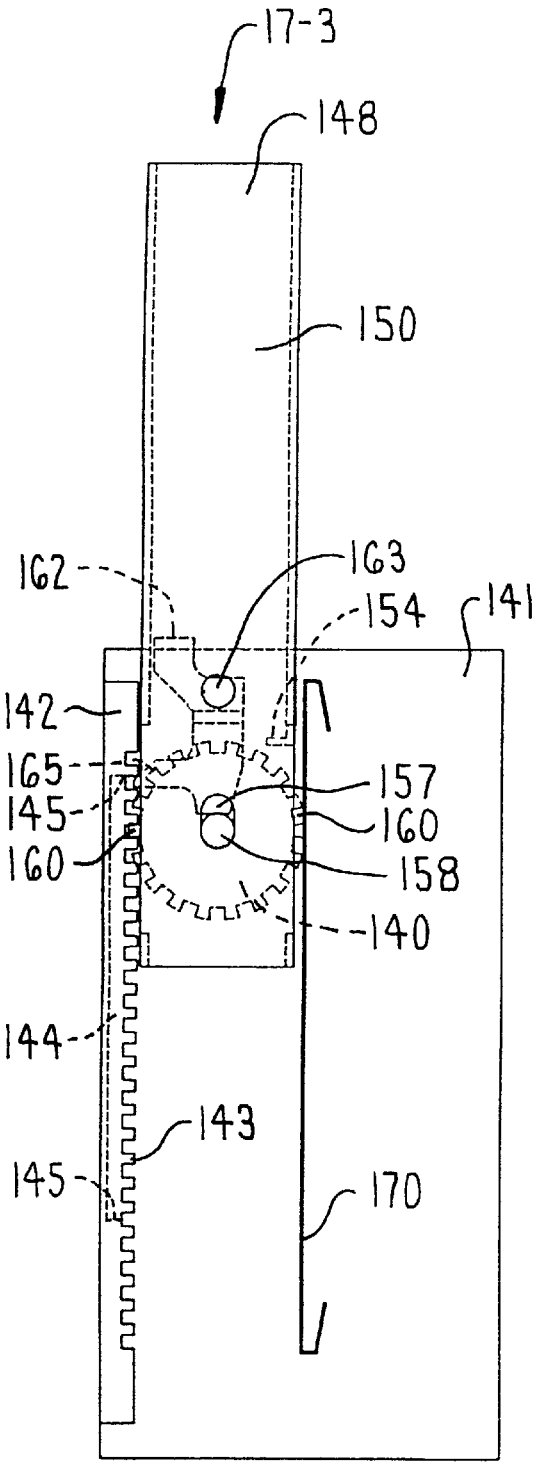
FIG. 20 is a front view of the third embodiment with a chair component support tube at an upper limit of travel.

At the upper limit of travel, however, the fingers 165 strike the upper abutment surfaces 145 of the slots 144 which pivots the lever 162 toward the gear 140 as seen in FIG. 20. Since the gear 140 is being pulled downwardly to the bottom of the slots 157 as seen in FIG. 20, the lever 162 is able to swing the bottom end 166 thereof into contact with the axle pins 159. Specifically as to the bottom end 166, the bottom end 166 is formed from separate flanges which contact both of the axle pins 159 with the gear being received therebetween.

Figure 21:
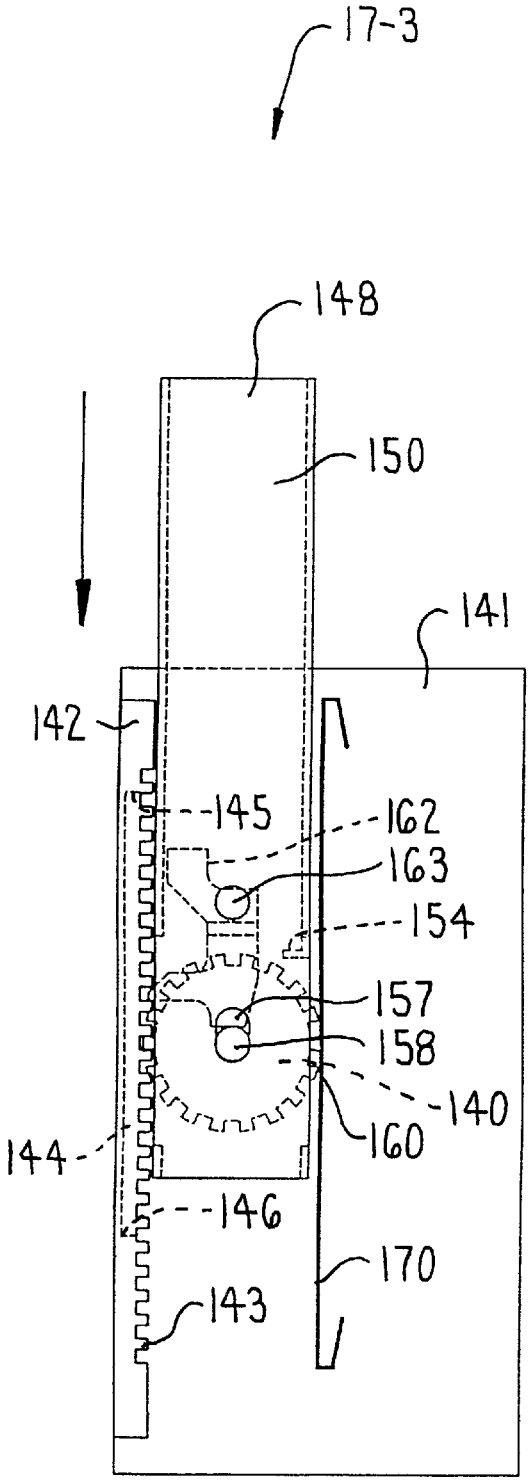
FIG. 21 is a front view illustrating the support tube being lowered.

With the bottom end 166 contacting the axle pins 159, downward movement of the housing 150 is prevented which prevents reengagement of the locking member 154 with the gear teeth 160. The gear 140 is still able to rotate which thereby permits the gear assembly 148 and the back assembly attached thereto to drop downwardly as seen in FIG. 21 to the lower travel limit.

Figure 22:
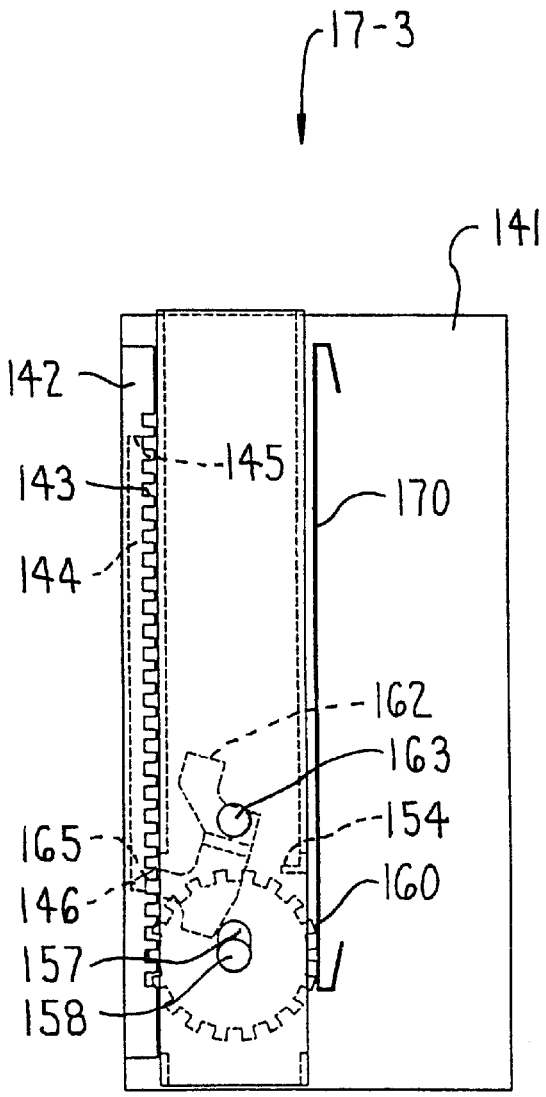
FIG. 22 is a front view of the support tube at a lower limit of travel.

At the lower limit illustrated in FIG. 22, the lower abutment surfaces 146 of the slots 144 contact the lever fingers 165 respectively to pivot the lever 162 clockwise away from the gear 140. This thereby permits the locking projection 154 to shift downwardly and reengage the gear 140 (FIG. 18) thus locking out downward movement of the back assembly. Upward movement of the back assembly, however, is still permitted (FIG. 19).

To provide drag on the gear 140, a flat resistance spring 170 is fixed to the rack plate 141. The spring 170 lies against the ends of the gear teeth 160 which project sidewardly from the housing opening 153 and thereby acts to brake the gear 140 and provide drag on the gear 140.

This embodiment provides a silent height adjustment mechanism wherein the gear assembly 148 is movable vertically with the back.

A fourth embodiment of a height adjustment mechanism is diagrammatically illustrated in FIGS. 24–28 and is identified by reference numeral 17-4. The fourth height adjustment mechanism 17-4 includes a gear assembly 170 which is stationarily supported on a chair upright, and a rack member 171 which is vertically movable with the back assembly or other body supporting member of the chair. The height adjustment mechanism 17-4 operates similar to the above described embodiments except that a gear 172 of the gear assembly 170 is not vertically shiftable.

More particularly, the rack member 171 includes a vertically elongate rack 173 defined by vertically spaced apart rack teeth 174. The rack member 171 further includes an upper abutment member 176 having a downward facing stop surface 177, and a lower abutment member 178 having an upward projecting abutment rib 179. As diagrammatically illustrated in FIGS. 25–28, the rack member 171 is movable vertically upwardly and downwardly due to its connection to the back assembly.

As for the gear assembly 170, the gear assembly includes a housing plate 180 having a forward facing surface 181 along which the rack member 171 slides in facing engagement therewith.

Figure 25:
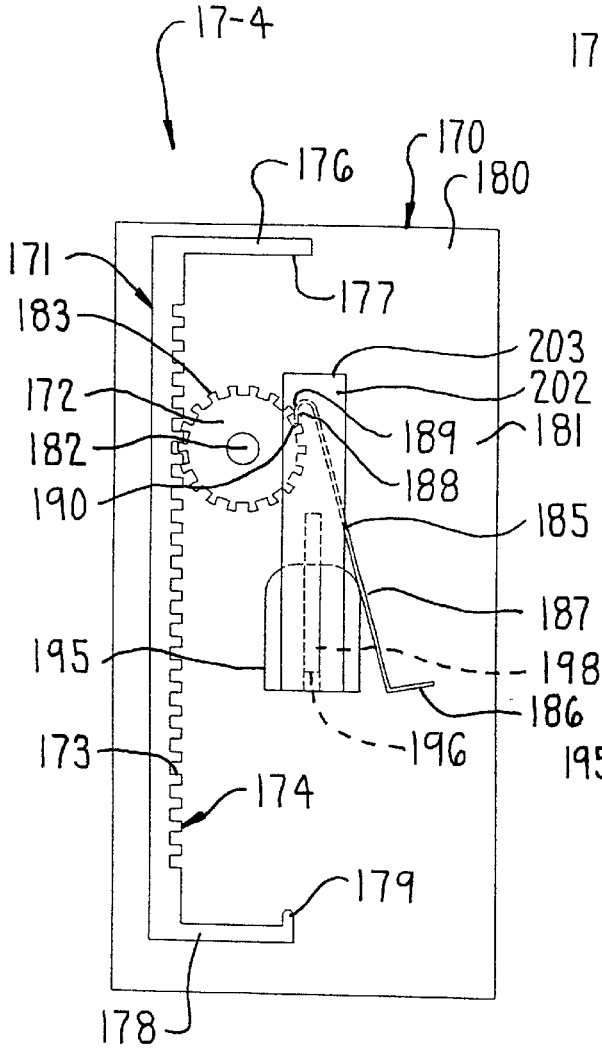
FIG. 25 is a front view of the rack member maintained at a selected elevation.

The housing plate 180 further includes a pivot pin 182 to which the gear 172 is rotatably connected. The gear 172 includes gear teeth 183 extending around the circumference thereof, which gear teeth 183 engage the rack teeth 174. Referring to FIG. 25, the gear assembly 170 further includes a resilient locking member 185 which is adapted to removably engage with the gear teeth 183.

More particularly, the locking member 185 includes a lower end 186 which is rigidly affixed to the front face 181 of the housing plate 180. The locking member 185 is formed of resilient spring steel and has a cantilevered engagement leg 187 which projects upwardly toward the gear 172.

The uppermost end 188 of the resilient leg 187 is curved downwardly into a hook-shape. This hooked end thereby defines a curved cam surface 189 which faces towards the gear teeth 183 and a downwardly projecting stop 190 which is adapted to abut against a side surface of individual gear teeth 183. The hooked end 188 presses into engagement with the gear teeth 183 due to the resiliency of the locking member 185 wherein the downwardly projecting stop 190 prevents counter-clockwise rotation of the gear 172 which thereby locks the cooperating rack member 171 at a selected elevation. However, if the rack member 171 is raised in combination with the back assembly of the chair, the gear can rotate in the clockwise direction since the gear teeth 183 act against the cam surface 189 and intermittently deflect the locking member 185 outwardly in a ratchet-like manner. Thus the engagement of the locking member 185 with the gear 172 permits raising of the rack member 171 while preventing downward movement of the rack member 171.

Figure 26:
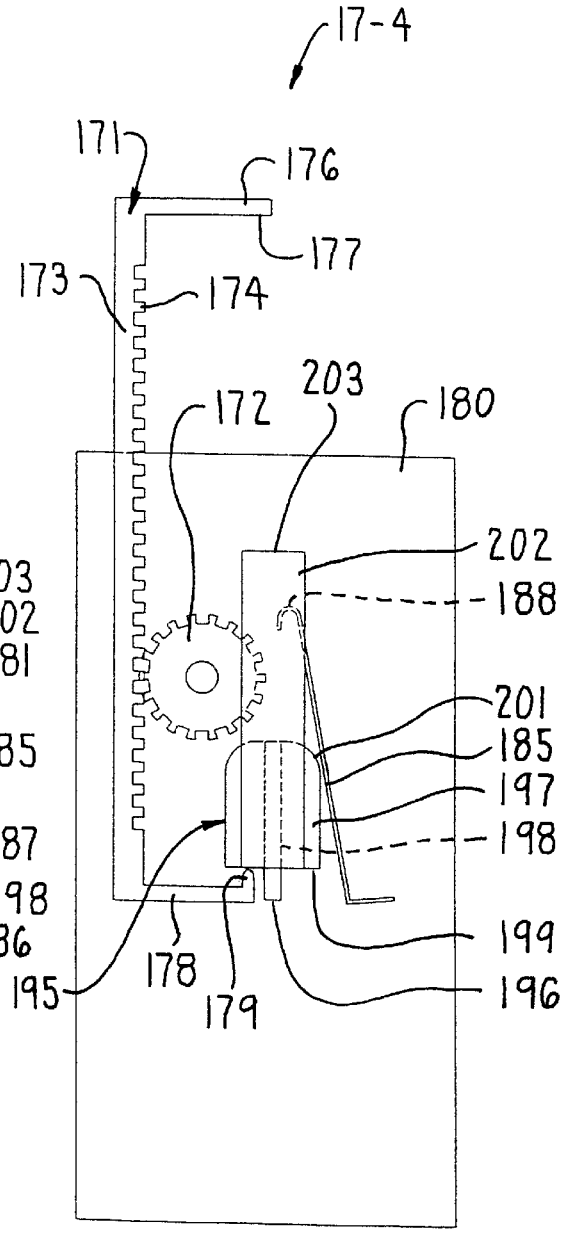
FIG. 26 is a front view of the rack member at an upper limit of travel.
Figure 27:
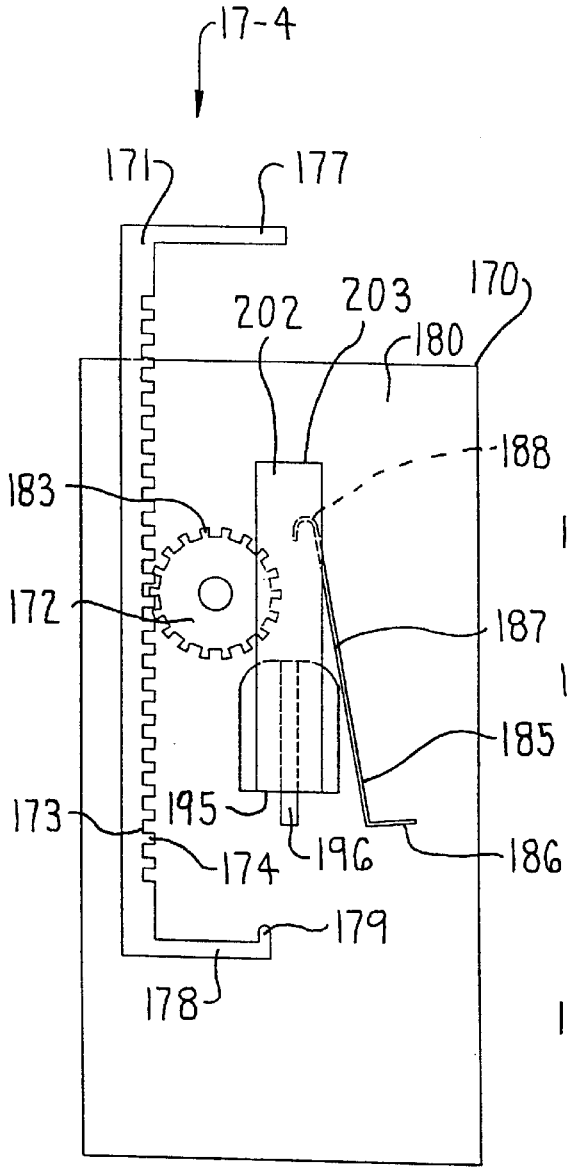
FIG. 27 is a front view illustrating the rack member being lowered.

To permit lowering of the back member, it is necessary to disengage or separate the locking member 185 and the gear teeth 183 one from the other. To accomplish this, a disengagement member 195 is provided. Specifically, the housing plate 180 as illustrated in FIGS. 25 and 26 includes a vertical support rib 196 on the front face 181 thereof. The disengagement member 195 includes a main body portion 197 having a corresponding slot 198 in the back side thereof which slides along the support rib 196 in a vertical direction. The main body portion 198 includes a bottom surface 199 which is contacted by the abutment projection 179 on the lower end of the rack member 171 at the upper limit of travel of the rack member 171. As seen in FIG. 26, the abutment projection 179 when contacting the bottom surface 199 of the locking member 195 displaces the locking member 195 upwardly along the support rib 196. The main body portion 198 includes a curved upper surface 201 which contacts the locking member 185 and normally permits the locking member 185 to engage the gear teeth 183 when in the lower position of FIG. 25. However, when the lock member 195 is pressed upwardly as described above with respect to FIG. 26, the upper surface 201 deflects the locking member 185 outwardly away from the gear 172. As a result, the gear 172 is now freely rotatable which permits the rack member 171 and the back assembly supported thereby to be lowered (FIG. 27). The locking member 195 is maintained in the disengagement position of FIG. 26 by the friction of the contacting surfaces of the slot 198 and the rib 196. Further, the locking member 185 when deflected outwardly, primarily presses sidewardly on the main body portion 197 rather than downwardly.

Figure 28:
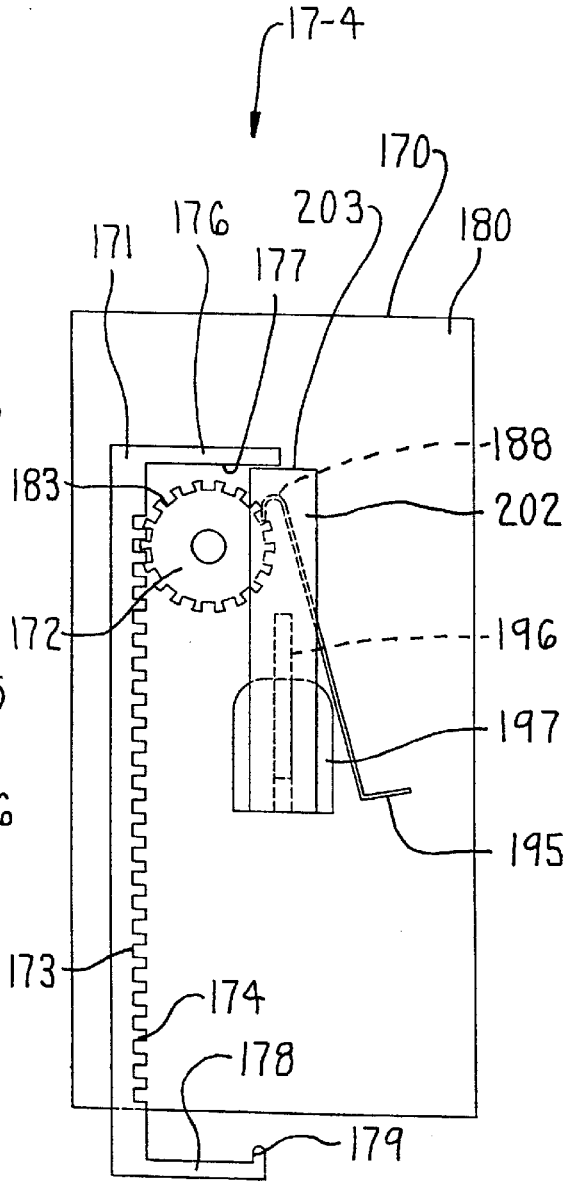
FIG. 28 is a front view of the rack member at a lower limit of travel.

Referring to FIG. 28, at the lower limit of travel of the back assembly, the rack member 171 acts on the disengagement member 195 to reengage the locking member 185 with the gear teeth 183. In particular, the locking member 195 includes an upwardly projecting plate 202 having an upper end surface 203 which is disposed vertically above the gear 172 and the locking member 185. This upper end surface 203 is adapted to contact the opposing surface 177 on the upper abutment member 176. As a result, downward movement of the rack member 171, pushes the disengagement member 195 downwardly as seen in FIG. 28 so that the locking member 185 resiliently moves back into engagement with the gear teeth 183. As such, rotation of the gear 172 is again restricted to counter-clockwise rotation which permits the rack member 171 to move upwardly but prevents downward movement of the rack member 171.

Figure 29:
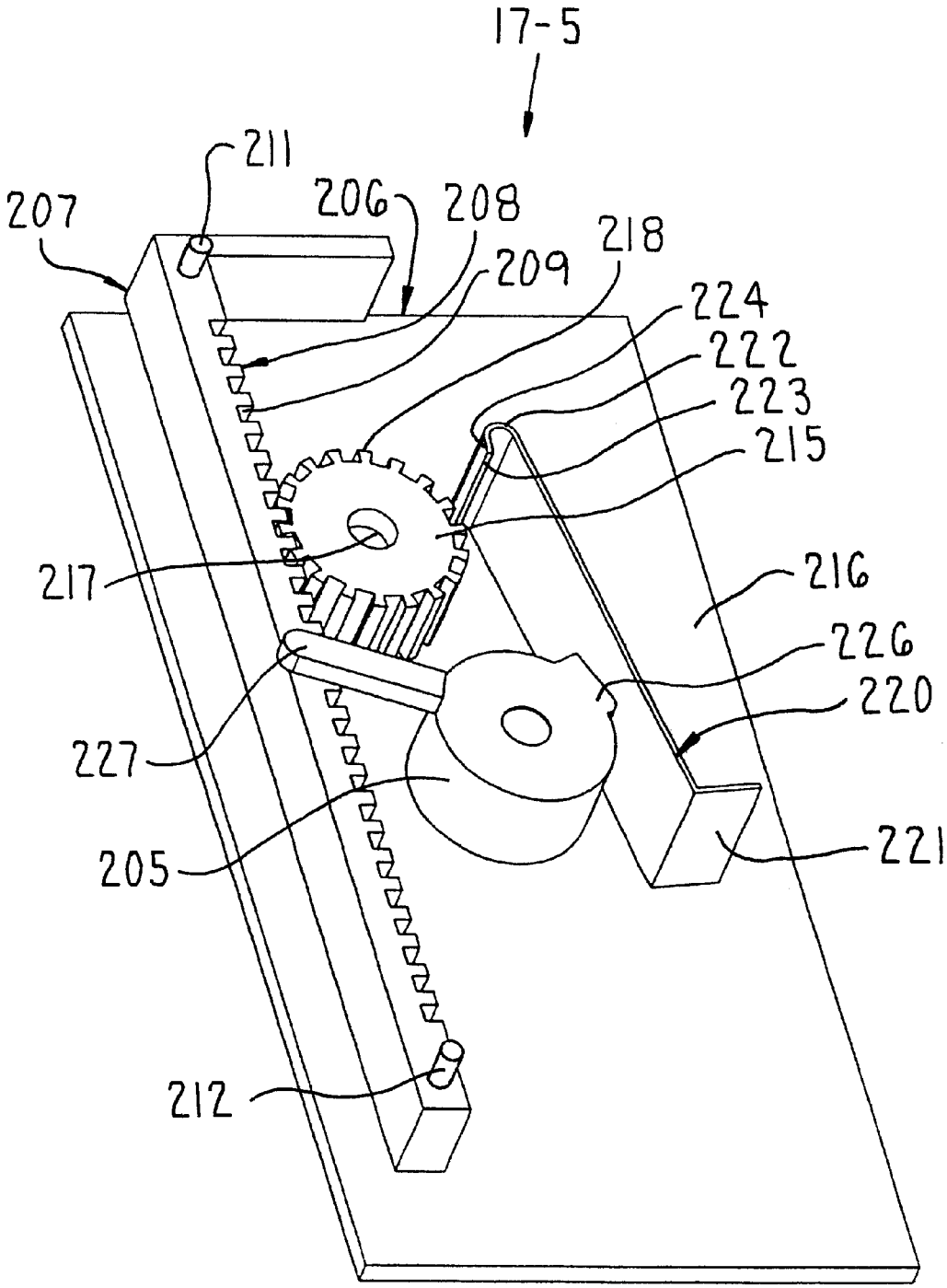
FIG. 29 is a perspective view of a fifth embodiment of the height adjustment mechanism having a rack member and a gear assembly similar to the fourth height adjustment mechanism in combination with a rotary disengagement member.
Figure 31:
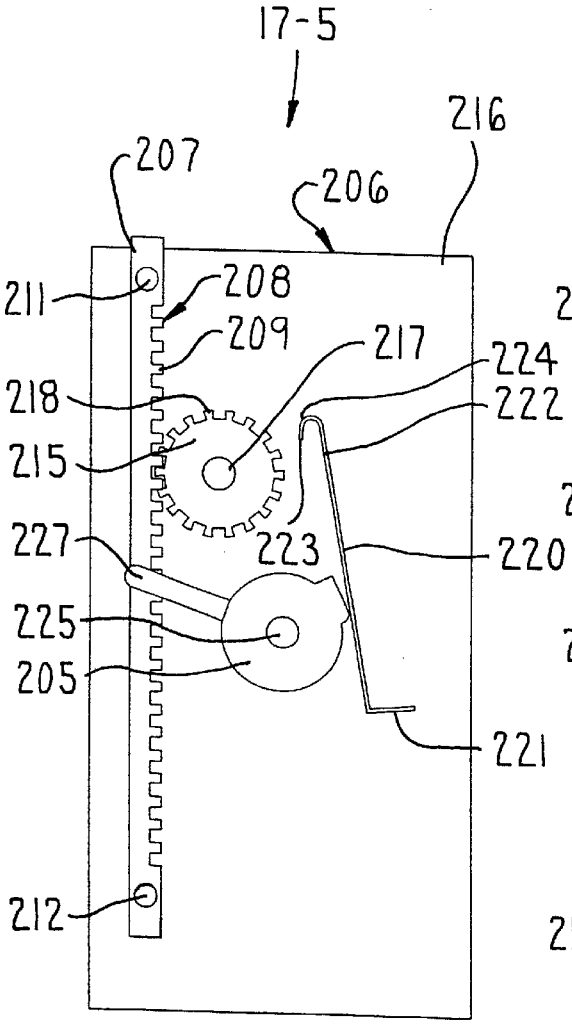
FIG. 31 is a front view illustrating the disengagement member rotated to an operative position.
Figure 30:
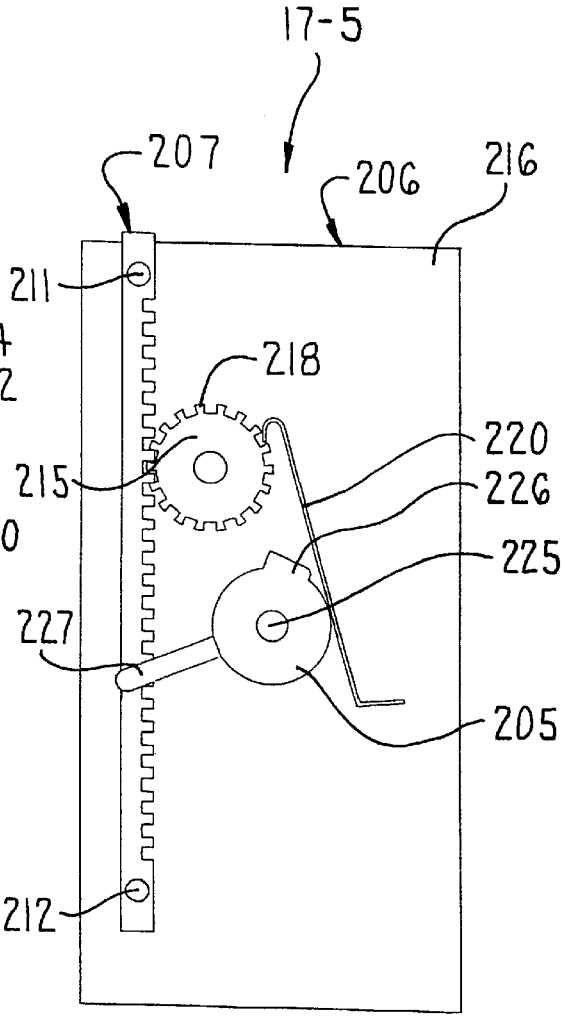
FIG. 30 is a front view illustrating the rack member supported at a selected elevation.

Referring to FIGS. 29–31, a fifth embodiment of the height adjustment mechanism is illustrated therein and identified by reference numeral 17-5. This arrangement is similar to the height adjustment mechanism 17-4 described above except that a rotary disengagement member 205 is provided. More particularly, the height adjustment mechanism 17-5 includes a gear assembly 206 which is stationarily mounted on a chair, and a rack member 207 which moves vertically in combination with the chair back. The rack member 207 is vertically elongate and includes a rack 208 defined by a plurality of vertically spaced apart rack teeth 209. The rack member 207 further includes an upper abutment post 211 and a lower abutment post 212.

As to the gear assembly 206, a gear 215 is rotatably connected to a housing plate 216 by a support pin 217. The gear teeth 218 of the gear 215 mesh with the teeth 209 of the rack 208. Further, a locking member 220 is provided having a lower end 221 fixed to the housing plate 216 and a hooked upper end 222 which is movable toward and away from the gear teeth 218. The upper end 222 includes a downwardly extending stop 223 and a curved cam surface 224.

The connection of the gear 215 and the locking member 220 to the housing plate 216 is identical to that described above with respect to the height adjustment mechanism 17-4 and further, the cooperation of the gear 215, locking member 222 and the rack 208 also is identical to that described above.

Generally, the locking member 220 engages the gear teeth 218 (FIG. 30) so as to permit clockwise movement of the gear 215 while preventing counter-clockwise movement thereof, which thereby permits raising of the rack member 207 while preventing downward movement thereof. To permit lowering of the back assembly of the chair, the rotary disengagement member 205 is rotatably connected to the housing plate 216 by a pivot pin 225. The disengagement member 205 includes a radial projection 226 which is adapted to contact and deflect the locking member 220 outwardly away from the gear 215 as seen in FIG. 31. The rotary disengagement member 205 also includes an actuator arm 227 which projects radially outwardly and is disposed vertically between the upper and lower abutment members 211 and 212 on the rack member 207.

During raising of the back assembly, the radial projection 226 is spaced counter-clockwise away from the locking member 220 so that the locking member 220 operably engages the gear teeth 218. However, at the upper limit of travel, the lower abutment post 212 contacts the actuator arm 227 and rotates the disengagement member 205 clockwise about the support pin 225. This movement rotates the radial projection 226 into contact with the locking member 220 to separate the upper end 222 thereof from the gear teeth 218 (FIG. 31). This permits downward movement of the rack member 207 and allows the back assembly to be lowered. At the lower limit of travel, the upper abutment post 211 then contacts the actuator arm 227 and rotates the disengagement member 205 counter-clockwise to the position illustrated in FIG. 30, which separates the radial projection 226 from the locking member 220 and allows reengagement of the locking member 220 with the gear teeth 218.

With this arrangement, the back assembly can be raised to a selected elevation and maintained at this elevation, and if the back assembly needs to be lowered, then the rack member 207 is moved to the upper limit of travel to automatically disengage the locking member 220 and allow lowering of the back assembly. At the lower limit of travel, the locking member 220 again is automatically reengaged with the gear teeth 218 without the necessity of separate actuator mechanisms.

It will be understood that the invention as illustrated in FIGS. 1–31 preferably operates automatically at the upper and lower limits of travel. However, it also will be understood that actuator mechanisms may be connected to the various disengagement members to separate the locking members from the associated gear teeth. While this arrangement is more complex, this also permits separation of the locking members 220 from the gear teeth at any elevation and permits lowering of the back assembly. Even if the manual actuators are used, the advantages of having a smooth operating gear associated with a rack is still provided.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. A chair comprising:

a seat assembly for supporting a user thereon;

an upright supported on the seat assembly which projects upwardly;

a body supporting chair component which is movably supported on said upright to permit adjustment of the height of the chair component between upper and lower limits of vertical travel; and a height adjustment mechanism connecting said chair component and said upright together, said height adjustment mechanism including a gear assembly on one of said upright and said chair component and a rack member supported on the other of said upright and said chair component, said rack member including a vertically elongate rack defined by a plurality of rack teeth, and said gear assembly having a gear housing and a gear which is rotatably supported on said gear housing, said gear having gear teeth which extend about a circumference of said gear and continuously mesh with said rack teeth during raising and lowering of said chair component between said upper and lower limits of travel wherein said gear rotates in response to relative vertical movement between said rack and said gear assembly, said gear assembly further including a locking member which is engagable with said gear to prevent rotation thereof wherein said gear and said locking member are movable away from each other out of engagement during raising of said chair component to permit rotation of said gear and movable toward each other into engagement to prevent rotation of said gear which prevents lowering of said chair component by said meshing of said gear teeth and said rack teeth, said gear assembly further including a disengagement member which is movable between an operative position which maintains said gear and said locking member separated to permit lowering of said chair component and an inoperative position to permit said gear and said locking member to move toward and away from each other during raising of said chair component.

2. The chair according to claim 1, wherein one of said gear and said locking member is in a fixed position on said housing and the other of said gear and said locking member is movably supported on said housing.

3. The chair according to claim 2, wherein said gear is movably supported on said housing so as to be vertically shiftable, said gear being movable vertically away from said locking member in response to relative vertical movement of said rack during raising of said chair component and being movable toward said locking member into engagement therewith under the weight of said chair component.

4. The chair according to claim 3, wherein first and second actuator members are provided on said rack member, said first and second actuator members being vertically spaced apart and being positioned to move said disengagement member between said operative position and said inoperative position.

5. The chair according to claim 4, wherein said first actuator member acts on said disengagement member when said chair component is at an upper limit of travel to move said disengagement member to said operative position and permit lowering of said chair component, said second actuator member acting on said disengagement member at a lower limit of the travel of said chair component to move said disengagement member to said inoperative position.

6. The chair according to claim 5, wherein said rack member is connected to said chair component so as to move vertically therewith, said first actuator member being disposed below said second actuator member.

7. The chair according to claim 5, wherein said gear assembly moves vertically with said chair component, said first actuator member being disposed vertically above said second actuator member.

8. The chair according to claim 1, wherein said disengagement member is slidable vertically along said housing.

9. The chair according to claim 1, wherein said disengagement member is a pivotable lever.

10. The chair according to claim 1, wherein said gear is rotatably attached to said housing at a fixed vertical position.

11. The chair according to claim 10, wherein said disengagement member includes a stop surface which prevents rotation of said gear in a first rotational direction, and includes a cam part which moves said disengagement member out of engagement with said gear teeth in response to rotation of said gear in a second rotational direction which is opposite said first rotational direction.

12. An article of furniture comprising:

a fixed support member;

a movable furniture component which is movable vertically relative to said fixed support member in opposite vertical directions; and a height adjustment mechanism interconnected between said movable furniture component and said fixed support member, said height adjustment mechanism including a rack member fixedly connected to one of said fixed support member and said movable furniture component and a gear assembly which is fixedly connected to the other of said fixed support member and said movable furniture component, said rack member having a vertically elongate rack comprising a vertical row of rack teeth, and said gear assembly including a housing having a rotatable gear supported thereon, said gear having gear teeth which mesh with said rack teeth during movement of said movable furniture component in both of said opposite vertical directions such that said gear rotates in response to relative vertical movement between said rack member and said gear assembly, said housing further including a locking member which is engagable with said gear to prevent gear rotation such that said gear prevents movement of said rack, said gear being shiftable vertically away from said locking member during lifting of said movable furniture component wherein gear rotation is permitted and back toward said locking member after lifting of said movable furniture component wherein gear rotation is prevented.

13. The article according to claim 12, wherein said housing includes a vertically elongate pocket which confines said gear therein, said pocket having a width which maintains said gear in meshing engagement with said rack teeth and a height which allows vertical movement of said gear within said pocket.

14. The article according to claim 13, wherein said locking member is defined on a bottom edge of said pocket.

15. The article according to claim 12, wherein said gear includes at least one axle pin which projects sidewardly therefrom to define a rotation axis about which said gear rotates and said housing includes a vertically elongate slot in which said axle pin is rotatably received.

16. The article according to claim 12, wherein said gear assembly includes a disengagement member which is movable to an operative position to shift said gear away from said locking member to permit lowering of said movable furniture component, and an inoperative position which permits vertical shifting of said gear toward and away from said locking teeth during lifting of said movable furniture component.

17. The article according to claim 16, wherein said rack member includes first and second actuator members which are vertically spaced apart, said first actuator member being engagable with said disengagement member when said movable furniture component is at an upper limit of travel to move said disengagement member to the operative position, and said second actuator member being engagable with said disengagement member when said movable furniture component is at a lower limit of travel to move said disengagement member to the inoperative position.

18. An article of furniture comprising:

a fixed support member;

a movable furniture component which is manually movable relative to said fixed support member; and a position adjustment mechanism interconnecting said movable furniture component to said fixed support member, said position adjustment mechanism including a rack member fixedly connected to one of said fixed support member and said movable furniture component and a gear assembly which is fixedly connected to the other of said fixed support member and said movable furniture component, said rack member having a row of rack teeth, and said gear assembly including a housing having a rotatable gear supported thereon, said gear having gear teeth which mesh with said rack teeth such that said gear rotates in response to relative vertical movement between said rack member and said gear assembly during raising of said movable furniture component, said housing including a locking member which is removably engaged with said gear to prevent gear rotation and maintain said movable furniture component at a selected elevation and disengagable from said gear during manual movement of said movable furniture component such that noise-generating contact is avoided between said gear and said locking member, said housing further including a clicker member engagable with said rack member to produce audible clicking sounds during raising of said movable furniture component.

19. The article according to claim 18, wherein said clicker member includes a fixed end fixed to said housing and a flexible end which engages said rack teeth and moves vertically from one rack tooth to another.

20. The article according to claim 18, wherein said gear rolls along said rack teeth during raising of said movable furniture component to minimize noise generated thereby.

21. An article of furniture comprising:

a fixed support member;

a movable furniture component which is manually movable relative to said fixed support member along an adjustment path; and a position adjustment mechanism interconnected between said movable furniture component and said fixed support member, said position adjustment mechanism including a rack disposed on one of said fixed support member and said movable furniture component and extending along said adjustment path, and a gear assembly which is disposed on the other of said fixed support member and said movable furniture component, said gear assembly having a rotatable gear meshing with said rack such that said gear rotates in response to relative movement between said rack and said gear assembly during manual movement of said movable furniture component, said gear assembly further including a locking member which is removably engaged with said gear in locked engagement to prevent gear rotation wherein said gear supports a weight of said movable furniture component on said fixed support member through said meshing of said gear with said rack, said gear and said locking member being automatically disengaged from each other by manual movement of said movable furniture component and reengaged in said locked engagement upon a release of said movable furniture component, said gear assembly further including a disengagement member which is movable between an operative position which maintains said gear and said locking member disengaged to permit lowering of said chair component and an inoperative position to permit said gear and said locking member to permit said automatic disengagement during raising of said chair component.

22. The article according to claim 21, wherein said gear assembly includes a support body which rotatably supports said gear on said one of said fixed support member and said movable furniture component, said locking member being defined on an edge of said support body and engaging gear teeth on said gear, said gear being displaceable relative to said support body wherein said rack pulls said gear out of engagement with said locking member during manual movement of said movable furniture component.

23. The article according to claim 22, wherein said disengagement member is slidable generally along said adjustment path, first and second actuator members being provided next to opposite ends of said rack, said first and second actuator members being positioned to move said disengagement member between said operative position and said inoperative position.

24. The article according to claim 21, wherein first and second actuators are provided next to said rack near opposite ends of said adjustment path, said first and second actuators being positioned to move said disengagement member between said operative position and said inoperative position.

25. The article according to claim 21, wherein said movable furniture component moves vertically.

26. A chair comprising:

a fixed support member;

a movable furniture component which is manually movable relative to said fixed support member along a vertically-elongate adjustment path; and a position adjustment mechanism interconnected between said movable chair component and said fixed support member, said position adjustment mechanism including a rack disposed on said fixed support member and extending along said adjustment path, and a gear assembly which is disposed on said movable furniture component, said gear assembly having a rotatable gear meshing sidewardly with said rack such that said gear rotates in response to relative vertical movement between said rack and said gear assembly during manual movement of said movable furniture component, said gear assembly further including a locking member which is engageable with said teeth of said gear in a locking position wherein said gear supports the weight of said movable furniture component on said fixed support member through said meshing of said gear with said rack, said locking member and said gear being relatively movable such that said locking member is displaceable to an unlocked position to permit rotation of said gear and allow for said manual movement of said movable furniture component, said locking member being automatically disposed in said locked position upon a release of said movable furniture component, and said gear assembly further including a disengagement member which is movable between an operative position and an inoperative position, said disengagement member when in said inoperative position permitting movement of said locking member between said locked and unlocked positions such that said movable furniture component is movable only in a first direction along said adjustment path, said disengagement member when in said inoperative position maintaining said locking member in said unlocked position relative to said gear to permit movement of said movable furniture component along said adjustment path in a second direction opposite to said first direction.

27. The chair according to claim 26, wherein first and second actuators are provided next to said rack near opposite ends of said adjustment path, said first and second actuators being positioned to move said disengagement member between said operative position and said inoperative position.

28. The chair according to claim 26, wherein said moveable furniture component defines an exterior surface configured to support a body of a chair user.

* * * * *